US010124947B2

(12) United States Patent
Pinkstone et al.

(10) Patent No.: US 10,124,947 B2
(45) Date of Patent: Nov. 13, 2018

(54) CARTON WITH DISPENSING FEATURES

(71) Applicant: Graphic Packaging International, LLC, Atlanta, GA (US)

(72) Inventors: Felicia A. Pinkstone, Aston, PA (US); Bradley J. Burke, Wheaton, IL (US); Kelly R. Fitzwater, Lakewood, CO (US); Tony Hancock, Eatonton, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 88 days.

(21) Appl. No.: 14/545,812

(22) Filed: Jun. 23, 2015

(65) Prior Publication Data

US 2015/0368019 A1 Dec. 24, 2015

Related U.S. Application Data

(60) Provisional application No. 61/998,300, filed on Jun. 23, 2014.

(51) Int. Cl.

| | |
|---|---|
| ***B65D 77/06*** | (2006.01) |
| ***B65D 5/54*** | (2006.01) |
| ***B65D 5/02*** | (2006.01) |
| ***B65D 5/74*** | (2006.01) |
| ***B65D 5/56*** | (2006.01) |

(52) U.S. Cl.

CPC ..... *B65D 77/062* (2013.01); *B65D 5/541* (2013.01); *B65D 5/544* (2013.01); *B65D 5/563* (2013.01); *B65D 5/742* (2013.01); *B65D 5/743* (2013.01); *B65D 5/0227* (2013.01)

(58) Field of Classification Search

CPC .... B65D 77/062; B65D 5/0227; B65D 5/541; B65D 5/745

USPC ... 229/117.3, 215, 117.27, 217, 117.32, 248; 53/452

See application file for complete search history.

(56) References Cited

U.S. PATENT DOCUMENTS

| | | | |
|---|---|---|---|
| 1,145,668 | A | 7/1915 | Brown |
| 1,478,791 | A | 12/1923 | Nelson |
| 1,762,703 | A | 6/1930 | Smith |
| 1,772,625 | A | 8/1930 | Caulfield |
| 1,837,750 | A | 12/1931 | Becker |
| 1,842,237 | A | 1/1932 | Becker |
| 1,844,952 | A | 2/1932 | Freedman et al. |
| 1,869,751 | A | 8/1932 | Iacobitti |
| 1,911,215 | A | 5/1933 | Walter |

(Continued)

FOREIGN PATENT DOCUMENTS

| | | |
|---|---|---|
| CA | 873185 | 6/1971 |
| CH | 412 695 | 4/1966 |

(Continued)

*Primary Examiner* — Christopher Demeree

(74) *Attorney, Agent, or Firm* — Womble Bond Dickinson (US) LLP

(57) ABSTRACT

A package for holding a product. The package can comprise a carton and a bag. The carton can comprise a plurality of panels extending at least partially around an interior of the carton and a dispenser for accessing the interior of the carton. The dispenser can comprise at least one dispenser flap at least partially closing a top of the carton. The bag can be at least partially disposed in the interior of the carton, and the bag can comprise a dispenser feature that is accessible via the dispenser in the carton.

59 Claims, 25 Drawing Sheets

(56) References Cited

U.S. PATENT DOCUMENTS 1,920,653 A 8/1933 McLaughlin
1,925,102 A 9/1933 Levkoff
1,973,960 A 9/1934 McLaughlin
2,005,924 A 6/1935 Wilson
2,006,203 A 6/1935 Leslie
2,010,863 A 8/1935 Johnson
2,067,749 A 1/1937 Zimmerman et al.
2,098,818 A 11/1937 Andrews
2,115,673 A 4/1938 Stompe
2,192,722 A 3/1940 Vogt
2,299,027 A 10/1942 Novak
2,343,222 A 2/1944 Nelson
2,346,134 A 4/1944 Kirkland et al.
2,348,377 A 5/1944 Goodyear
2,355,665 A 8/1944 Mabee
2,361,984 A 11/1944 Williamson
2,407,781 A 9/1946 Guyer
2,475,677 A 7/1949 Ringler
2,502,117 A 3/1950 Anderson
2,509,289 A 5/1950 Dunning
2,576,594 A 11/1951 Goldstein
2,593,778 A 4/1952 McGinnis
2,634,897 A 4/1953 Bord
2,669,351 A 2/1954 Carson et al.
2,683,953 A 7/1954 Hopkins
2,701,678 A 1/1955 Read
2,701,679 A 2/1955 Goldstein
2,706,076 A 4/1955 Guyer
2,738,916 A 3/1956 Peters
2,754,047 A 7/1956 Schmidt et al.
2,775,393 A 12/1956 Rugg
2,778,557 A 1/1957 Moore
2,820,585 A 1/1958 Nerenberg et al.
2,848,151 A 8/1958 O'Neil
2,862,649 A 12/1958 Bergstein
2,902,201 A 9/1959 Engblom
2,934,251 A 4/1960 Kramer
2,944,726 A 7/1960 McCauley
2,989,224 A 6/1961 Umanoff
2,993,632 A 7/1961 De Feo
3,017,065 A 1/1962 Collie
3,048,324 A 8/1962 Anderson
3,078,032 A 2/1963 Robinson et al.
3,085,733 A 4/1963 Umanoff
3,116,866 A 1/1964 Boran
3,127,082 A 3/1964 Meyer-Jagenberg
3,128,010 A 4/1964 Forrer
3,133,634 A 5/1964 Bozdar
3,133,688 A 5/1964 Asman
3,136,471 A * 6/1964 Brastad ..... B65D 5/541 229/117.32
3,137,437 A 6/1964 Svensson
3,147,904 A 9/1964 Larson
3,159,326 A 12/1964 Stonebanks
3,164,298 A 1/1965 Repko
3,178,242 A 4/1965 Ellis et al.
3,184,136 A 5/1965 Forbes, Jr.
3,228,582 A 1/1966 Osberg
3,250,436 A 5/1966 Kurtz
3,254,793 A 6/1966 Palmer
3,263,861 A 8/1966 Carr
3,265,283 A 8/1966 Farquhar
3,300,115 A 1/1967 Schauer
3,332,594 A 7/1967 De Capua
3,346,167 A 10/1967 Schmidt
3,347,446 A 10/1967 Guyer et al.
3,355,089 A 11/1967 Champlin
3,356,279 A 12/1967 Root
3,363,822 A 1/1968 Maulini et al.
3,395,848 A 8/1968 Johnson
3,414,182 A 12/1968 Fobiano
3,417,911 A 12/1968 Hennessey
3,426,955 A 2/1969 Olson
3,438,565 A 4/1969 Lugt et al.
3,517,858 A 6/1970 Farquhar
3,533,549 A 10/1970 Gilchrist
3,540,581 A 11/1970 Koolnis
3,580,466 A 5/1971 Thelen et al.
3,580,483 A 5/1971 Young
3,587,944 A 6/1971 Pehr
3,605,578 A 9/1971 Sternau
3,640,447 A 2/1972 Forbes, Jr. et al.
3,669,345 A 6/1972 Cote
3,680,766 A 8/1972 Collura et al.
3,690,544 A 9/1972 Meyers
3,712,533 A 1/1973 Skillen
3,764,058 A 10/1973 Forbes, Jr.
3,767,107 A 10/1973 Forbes, Jr.
3,768,719 A 10/1973 Johnson
3,831,836 A 8/1974 Ellison et al.
3,891,137 A 6/1975 Ellison et al.
3,905,646 A 9/1975 Brackmann et al.
3,951,333 A 4/1976 Forbes, Jr. et al.
3,981,430 A 9/1976 Keim
4,015,768 A 4/1977 McLennan
4,027,794 A 6/1977 Olson
4,046,307 A 9/1977 Booth et al.
4,094,456 A 6/1978 Raccaforte
4,095,735 A 6/1978 Stone
4,138,016 A 2/1979 Roccaforte
4,141,485 A 2/1979 Lambert
4,150,778 A 4/1979 Engdahl, Jr.
4,154,346 A * 5/1979 Heuberger ..... B65D 77/02 229/117.27
4,155,449 A 5/1979 Bryne
4,165,030 A 8/1979 Bunger et al.
4,168,003 A 9/1979 Wysocki
4,194,677 A 3/1980 Wysocki
4,201,292 A 5/1980 Davidson
4,201,329 A 5/1980 Roccaforte
4,214,660 A 7/1980 Hunt, Jr.
4,222,485 A 9/1980 Focke
4,256,226 A 3/1981 Stone
4,308,956 A 1/1982 Steinke et al.
4,318,474 A 3/1982 Hasegawa
4,341,338 A 7/1982 Arnold
4,344,537 A 8/1982 Austin
4,345,393 A 8/1982 Price et al.
4,361,270 A 11/1982 Roccaforte
4,364,509 A 12/1982 Holley, Jr. et al.
4,371,109 A 2/1983 Tanner et al.
4,375,258 A 3/1983 Crayne et al.
4,376,509 A 3/1983 Schaffer
4,378,877 A 4/1983 Botterman et al.
4,396,143 A 8/1983 Killy
4,411,365 A 10/1983 Horikawa et al.
4,417,655 A 11/1983 Forbes, Jr.
4,417,661 A 11/1983 Roccaforte
4,441,614 A 4/1984 Gulliver
4,458,810 A 7/1984 Mahoney
4,484,683 A 11/1984 Werner, Jr.
4,508,218 A 4/1985 Focke et al.
4,546,884 A 10/1985 Kuchenbecker
4,548,318 A 10/1985 Boyle
4,558,785 A 12/1985 Gordon
4,565,315 A 1/1986 Wagner et al.
4,577,762 A 3/1986 Kuchenbecker
4,605,128 A 8/1986 Rieke
4,608,038 A 8/1986 Virta et al.
4,609,142 A 9/1986 Adamek
4,645,108 A 2/1987 Gavin et al.
4,658,984 A 4/1987 Brunner
4,676,394 A 6/1987 Hiersteiner
4,768,703 A 9/1988 Sosler et al.
4,781,317 A 11/1988 Ditto
4,782,788 A 11/1988 Arcand
4,802,590 A 2/1989 Smith
4,811,894 A 3/1989 Schuster
4,813,546 A 3/1989 Gordon et al.
4,817,866 A 4/1989 Wonnacott
4,890,440 A 1/1990 Romagnoli
4,905,898 A 3/1990 Wade
4,909,395 A 3/1990 Weissman
4,913,292 A 4/1990 Field

(56) References Cited

U.S. PATENT DOCUMENTS 4,946,540 A 8/1990 Mitchard
4,948,033 A 8/1990 Halsell, II et al.
4,949,845 A 8/1990 Dixon
4,953,781 A 9/1990 Bryan
4,974,771 A 12/1990 Lavery
4,989,735 A 2/1991 O'Brien
5,012,959 A 5/1991 Gordon
5,014,888 A 5/1991 Bryan
5,031,825 A 7/1991 Romagnoli
5,050,742 A 9/1991 Muckenfuhs
5,056,708 A 10/1991 Boyle et al.
5,069,359 A 12/1991 Liebel
5,071,010 A 12/1991 Carufel/Zeman
5,078,273 A 1/1992 Kuchenbecker
5,083,667 A 1/1992 Holder
5,092,516 A 3/1992 Kastanek
5,101,642 A 4/1992 Alexandrov
5,107,120 A 4/1992 Tom
5,110,042 A 5/1992 Hurden
5,125,568 A 6/1992 Bauer
5,129,875 A 7/1992 Chaygneaud-Dupuy
5,137,211 A 8/1992 Summer et al.
5,141,150 A 8/1992 Plaessman
5,145,091 A 9/1992 Meyers
5,147,272 A 9/1992 Richison et al.
5,147,480 A 9/1992 Lang
5,166,681 A 11/1992 Bottesch et al.
5,215,250 A 6/1993 Roccaforte
5,219,229 A 6/1993 Sengewald
5,222,660 A 6/1993 Koss
5,238,181 A 8/1993 Mahler
5,249,681 A 10/1993 Miller
5,251,808 A 10/1993 Rudd
5,259,552 A 11/1993 Kuchenbecker
5,285,956 A 2/1994 Piepho
5,292,058 A 3/1994 Zoss et al.
5,328,091 A 7/1994 Koss
5,347,865 A 9/1994 Mulry et al.
5,372,301 A 12/1994 Besson
5,373,960 A 12/1994 Gunn et al.
5,425,474 A 6/1995 Dalea et al.
5,429,297 A 7/1995 Walsh
5,445,316 A 8/1995 Roccaforte
5,450,680 A 9/1995 Bromberg
5,482,185 A 1/1996 McNaughton
5,505,372 A 4/1996 Edson et al.
5,544,806 A 8/1996 Anderson et al.
5,551,938 A 9/1996 Stone
5,577,612 A 11/1996 Chesson et al.
5,584,430 A 12/1996 Mulry
5,588,585 A 12/1996 McClure
5,597,114 A 1/1997 Kramedjian et al.
5,599,267 A 2/1997 Dupuy
5,601,521 A 2/1997 Plamas Xapelli
5,622,309 A 4/1997 Matsuda et al.
5,632,402 A 5/1997 Walsh
5,632,404 A 5/1997 Walsh
5,660,324 A 8/1997 Rowland
5,664,683 A 9/1997 Brody
5,668,539 A 9/1997 Patchell
5,678,755 A 10/1997 Block
5,680,986 A 10/1997 Botterman
5,690,213 A 11/1997 Matsumura
5,690,230 A 11/1997 Griffith
5,746,871 A 5/1998 Walsh
5,757,930 A 5/1998 Seidemann et al.
5,775,576 A 7/1998 Stone
5,783,030 A 7/1998 Walsh
5,794,778 A 8/1998 Harris
5,794,811 A 8/1998 Walsh
5,794,812 A 8/1998 Walsh
5,810,250 A 9/1998 Stone et al.
5,826,783 A 10/1998 Stout
5,857,614 A 1/1999 Walsh
5,875,961 A 3/1999 Stone et al.
5,876,317 A 3/1999 Sigrist et al.
5,881,884 A 3/1999 Podosek
5,893,513 A 4/1999 Stone et al.
5,918,799 A 7/1999 Walsh
5,921,398 A 7/1999 Carroll
5,924,559 A 7/1999 Carrel et al.
5,927,498 A 7/1999 Saam
5,967,374 A 10/1999 Baker
5,992,734 A 11/1999 Tokarski et al.
5,996,797 A 12/1999 Flaig
6,015,084 A 1/2000 Mathieu et al.
6,027,018 A 2/2000 Yocum
6,050,402 A 4/2000 Walter
6,050,484 A 4/2000 Galomb
6,059,182 A 5/2000 Wein
6,062,467 A 5/2000 Ours et al.
6,102,277 A 8/2000 Krapohl, Sr.
6,109,517 A 8/2000 Cabrera
6,110,095 A 8/2000 Finke et al.
6,120,184 A 9/2000 Laurence et al.
6,131,729 A 10/2000 Eckerman et al.
6,145,736 A 11/2000 Ours et al.
6,152,360 A 11/2000 Block et al.
6,158,653 A 12/2000 Kanter et al.
6,176,419 B1 1/2001 Holley, Jr.
6,189,777 B1 2/2001 Hutchinson
6,206,279 B1 3/2001 Countee
6,213,388 B1 4/2001 Ours et al.
6,221,192 B1 4/2001 Walsh
6,227,440 B1 5/2001 Hart
6,230,881 B1 5/2001 Collura
6,283,293 B1 9/2001 Lingamfelter
6,328,472 B1 12/2001 Laurence et al.
6,332,488 B1 12/2001 Walsh
6,336,584 B1 1/2002 Roch et al.
6,352,096 B1 3/2002 Walsh
6,386,438 B1 5/2002 Walsh et al.
6,409,077 B1 6/2002 Telesca et al.
D459,927 S 7/2002 Flowers et al.
6,419,151 B1 7/2002 Urtubey
6,424,272 B1 7/2002 Gutta et al.
6,435,402 B1 8/2002 Hengami
6,474,040 B1 11/2002 Ours et al.
6,478,216 B2 11/2002 Wiart
6,478,219 B1 11/2002 Holley, Jr.
6,484,903 B2 11/2002 Spivey et al.
6,550,615 B2 4/2003 Lingamfelter
6,557,699 B1 5/2003 Focke et al.
6,578,736 B2 6/2003 Spivey
6,604,677 B1 8/2003 Sutherland et al.
6,631,803 B2 10/2003 Rhodes et al.
6,634,546 B2 10/2003 Heeley et al.
6,669,083 B2 12/2003 Bates
6,676,009 B1 1/2004 Rose
6,689,034 B2 2/2004 Walsh
6,715,639 B2 4/2004 Spivey
6,752,262 B1 6/2004 Boriani et al.
6,753,766 B2 6/2004 Patchell
6,789,673 B2 9/2004 Lingamfelter
6,854,639 B2 2/2005 Walsh
6,866,185 B2 3/2005 Harrelson
6,866,186 B2 3/2005 Fogle et al.
6,866,188 B2 3/2005 Harrelson
6,889,892 B2 5/2005 Walsh et al.
6,896,130 B2 5/2005 Theelen
6,902,104 B2 6/2005 Holley, Jr. et al.
6,918,487 B2 7/2005 Harrelson
6,929,172 B2 8/2005 Bates et al.
6,945,450 B2 9/2005 Rusnock
6,948,293 B1 9/2005 Eckermann et al.
6,961,006 B2 11/2005 Harter, Jr. et al.
6,968,992 B2 11/2005 Schuster
6,969,172 B2 11/2005 Actis-Datta
6,974,072 B2 12/2005 Harrelson
6,991,107 B2 1/2006 Harrelson
6,997,316 B2 2/2006 Sutherland
7,000,803 B2 2/2006 Miller
7,025,504 B2 4/2006 Olin
7,036,714 B2 5/2006 Walsh et al.

(56) References Cited

U.S. PATENT DOCUMENTS

| | | | | |
|---|---|---|---|---|
| 7,059,494 | B2 | 6/2006 | Harrelson et al. | |
| 7,073,665 | B2 | 7/2006 | Auclair et al. | |
| 7,104,435 | B2 | 9/2006 | Holley, Jr. | |
| 7,134,593 | B2 | 11/2006 | Harrelson | |
| 7,148,482 | B2 | 12/2006 | Harter, Jr. | |
| 7,168,558 | B2 | 1/2007 | Harrelson | |
| 7,210,612 | B2 | 5/2007 | Walsh et al. | |
| 7,225,930 | B2 | 6/2007 | Ford et al. | |
| 7,237,674 | B2 | 7/2007 | Auclair | |
| 7,240,789 | B2 | 7/2007 | Sutherland | |
| 7,253,722 | B2 | 8/2007 | Deasy et al. | |
| 7,328,798 | B2 | 2/2008 | Holley, Jr. | |
| 7,648,024 | B2 | 1/2010 | Mitten et al. | |
| 7,658,318 | B2 | 2/2010 | Walsh et al. | |
| 7,665,629 | B2 | 2/2010 | Julius et al. | |
| 7,815,097 | B2 | 10/2010 | Fogle et al. | |
| 7,938,312 | B2 | 5/2011 | Ford | |
| 7,984,844 | B2 | 7/2011 | Jones | |
| 8,025,618 | B2 | 9/2011 | Walsh et al. | |
| 8,066,137 | B2 | 11/2011 | Sanfilippo et al. | |
| 8,418,885 | B2 | 4/2013 | Kasai | |
| 9,108,761 | B2 * | 8/2015 | Fitzwater | B65D 5/563 |
| 9,156,582 | B2 | 10/2015 | Walsh et al. | |
| 2001/0048022 | A1 | 12/2001 | Zoeckler | |
| 2002/0055429 | A1 | 5/2002 | Walsh | |
| 2002/0060240 | A1 | 5/2002 | Walsh | |
| 2002/0070139 | A1 | 6/2002 | Bates | |
| 2003/0057266 | A1 | 3/2003 | Sedo | |
| 2003/0136819 | A1 | 7/2003 | Walsh et al. | |
| 2003/0141313 | A1 | 7/2003 | Bates | |
| 2003/0144121 | A1 | 7/2003 | Walsh et al. | |
| 2003/0150759 | A1 | 8/2003 | White, Jr. | |
| 2003/0192907 | A1 | 10/2003 | Bates | |
| 2004/0089671 | A1 | 5/2004 | Miller | |
| 2004/0099558 | A1 | 5/2004 | Oliff et al. | |
| 2004/0155098 | A1 | 8/2004 | Harrelson | |
| 2004/0188300 | A1 | 9/2004 | Sutherland | |
| 2004/0226989 | A1 | 11/2004 | Cook et al. | |
| 2005/0023170 | A1 | 2/2005 | Lingamfelter | |
| 2005/0092820 | A1 | 5/2005 | Chekroune | |
| 2005/0103681 | A1 | 5/2005 | Aubry et al. | |
| 2005/0127150 | A1 | 6/2005 | Walsh et al. | |
| 2005/0187087 | A1 | 8/2005 | Walsh | |
| 2005/0189405 | A1 | 9/2005 | Gomes et al. | |
| 2005/0211903 | A1 | 9/2005 | Harter, Jr. | |
| 2005/0224564 | A1 | 10/2005 | Walsh | |
| 2005/0224565 | A1 | 10/2005 | Holley, Jr. | |
| 2005/0274086 | A1 | 12/2005 | Petrelli et al. | |
| 2005/0274782 | A1 | 12/2005 | Petrelli et al. | |
| 2006/0054522 | A1 | 3/2006 | Kline et al. | |
| 2006/0054675 | A1 | 3/2006 | Bennett | |
| 2006/0067378 | A1 | 3/2006 | Rege et al. | |
| 2006/0091193 | A1 | 5/2006 | DeBusk | |
| 2006/0118606 | A1 | 6/2006 | Holley, Jr. et al. | |
| 2006/0131370 | A1 | 6/2006 | Bates | |
| 2006/0175386 | A1 | 8/2006 | Holley, Jr. | |
| 2006/0243783 | A1 | 11/2006 | Spivey, Sr. et al. | |
| 2006/0255106 | A1 | 11/2006 | Green | |
| 2006/0255109 | A1 | 11/2006 | Green | |
| 2006/0255112 | A1 | 11/2006 | Sweet | |
| 2006/0255113 | A1 | 11/2006 | McGowan | |
| 2007/0131752 | A1 | 6/2007 | Jones | |
| 2008/0135605 | A1 * | 6/2008 | Manaige | B65D 5/745 229/117.3 |
| 2010/0019022 | A1 | 1/2010 | Ryan et al. | |
| 2010/0140129 | A1 | 6/2010 | Sanfilippo et al. | |
| 2011/0266298 | A1 | 11/2011 | Burgos Agudo | |
| 2013/0001284 | A1 | 1/2013 | Hengami | |

FOREIGN PATENT DOCUMENTS

| | | |
|---|---|---|
| DE | 1091851 | 10/1960 |
| DE | 29 23 455 | 12/1980 |
| DE | 81 10 323.9 | 9/1981 |
| DE | 33 07 758 | 9/1984 |
| DE | 87 08 078.8 | 10/1987 |
| DE | 89 08 393 | 9/1989 |
| DE | 43 08 047 | 12/1993 |
| DE | 93 20 241 5 | 3/1994 |
| DE | 94 13 813 | 10/1994 |
| DE | 10 2008 035 467 | 2/2010 |
| EP | 0 079 155 | 5/1983 |
| EP | 0 126 440 | 11/1984 |
| EP | 0 346 526 | 12/1989 |
| EP | 0 466 337 | 1/1992 |
| EP | 0 066 029 | 12/1992 |
| EP | 0 529 260 | 3/1993 |
| EP | 0 530 643 | 3/1993 |
| EP | 0 542 449 | 5/1993 |
| EP | 0 822 145 | 2/1998 |
| EP | 1 457 425 | 9/2004 |
| EP | 1 562 053 | 8/2005 |
| EP | 1 580 542 | 9/2005 |
| FR | 2 549 010 | 1/1985 |
| FR | 2 686 316 | 7/1993 |
| FR | 2 699 150 | 6/1994 |
| FR | 2 755 670 | 5/1998 |
| GB | 104445 | 3/1917 |
| GB | 385033 | 12/1932 |
| GB | 393199 | 6/1933 |
| GB | 1 242 356 | 8/1971 |
| GB | 1 489 963 | 10/1977 |
| GB | 1 584 066 | 2/1981 |
| GB | 2 264 101 | 8/1993 |
| GB | 2 275 913 | 9/1994 |
| GB | 2 363 372 | 12/2001 |
| GB | 0202809 | 2/2002 |
| GB | 2 379 923 | 3/2003 |
| JP | 44-25911 | 10/1969 |
| WO | WO 92/01606 | 2/1992 |
| WO | WO 95/28325 | 10/1995 |
| WO | WO 96/29260 | 9/1996 |
| WO | WO 97/27114 | 7/1997 |
| WO | WO 99/38779 | 8/1999 |
| WO | WO 99/64301 | 12/1999 |
| WO | WO 00/03937 | 1/2000 |
| WO | WO 00/74931 | 12/2000 |
| WO | WO 02/04302 | 1/2002 |
| WO | WO 02/11516 | 2/2002 |
| WO | WO 02/47990 | 6/2002 |
| WO | WO 03/051622 | 6/2003 |
| WO | WO 2004/043790 | 5/2004 |
| WO | WO 2005/051781 | 6/2005 |
| WO | WO 2005/082738 | 9/2005 |
| WO | WO 2006/050210 | 5/2006 |
| WO | WO 2006/050316 | 5/2006 |
| WO | WO 2006/124643 | 11/2006 |
| WO | WO 2006/133401 | 12/2006 |
| WO | WO 2008/086272 | 7/2008 |
| WO | WO 2009/018400 | 2/2009 |

* cited by examiner

CARTON WITH DISPENSING FEATURES

CROSS-REFERENCE TO RELATED APPLICATIONS

This application claims the benefit of U.S. Provisional Patent Application No. 61/998,300, filed Jun. 23, 2014.

INCORPORATION BY REFERENCE

The disclosures of U.S. Provisional Patent Application No. 61/998,300, which was filed Jun. 23, 2014, U.S. patent application Ser. No. 13/948,644, which was filed on Jul. 23, 2013, and U.S. patent application Ser. No. 13/923,416, which was filed on Jun. 21, 2013, are hereby incorporated by reference for all purposes as if presented herein in their entirety.

BACKGROUND OF THE DISCLOSURE

The present disclosure generally relates to cartons having dispensing features for accessing products in the interior of the carton.

SUMMARY OF THE DISCLOSURE

In general, one aspect of the disclosure is generally directed to a package for holding a product. The package can comprise a carton and a bag. The carton can comprise a plurality of panels extending at least partially around an interior of the carton and a dispenser for accessing the interior of the carton. The dispenser can comprise at least one dispenser flap at least partially closing a top of the carton. The bag can be at least partially disposed in the interior of the carton, and the bag can comprise a dispenser feature that is accessible via the dispenser in the carton.

In another aspect, the disclosure is generally directed to, in combination, a blank for forming a carton and a bag for being disposed in an interior of the carton. The blank can comprise a plurality of panels and dispenser features for forming a dispenser for accessing the interior of the carton formed from the blank. The dispenser features can comprise at least one dispenser flap for at least partially closing a top of the carton formed from the blank. The bag can comprise a dispenser feature that is for being accessible via the dispenser when the carton is formed from the blank.

In another aspect, the disclosure is generally directed to a method of forming a package. The method can comprise obtaining a blank comprising a plurality of panels and dispenser features comprising at least one dispenser flap, forming an interior of the carton at least partially defined by the plurality of panels, and positioning a bag at least partially in the interior of the carton. The bag can comprise a dispenser feature. The method further can comprise forming a dispenser at least partially defined by the dispenser features. The forming the dispenser can comprise positioning the at least one dispenser flap to at least partially close a top of the carton. The dispenser feature of the bag can be accessible via the dispenser.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts may be designated by corresponding reference numbers throughout the drawings.

DETAILED DESCRIPTION OF THE EXEMPLARY EMBODIMENTS

The present disclosure generally relates to a carton with dispensing features that may contain products such as flowable materials or food products (e.g., cereal) or any other flowable material (e.g., powder-type mixes, granular materials, salts or other crystallines, detergents, etc.). The carton can include a liner in the carton interior. The liner can be used to protect and store product in the carton. The liner can be made from materials suitable in composition for packaging the particular product, and the materials include, but are not limited to, plastics such as PET, LDPE, LLDPE, HDPE, PP, PS, PVC, EVOH, and Nylon; metals; papers; and the like, or any combination thereof. Alternatively, the liner can be omitted. In one or more embodiments, in this specification, the terms "front," "back," "lower," "bottom," "upper" and "top" indicate orientations determined in relation to fully erected and upright cartons.

Figure 1:
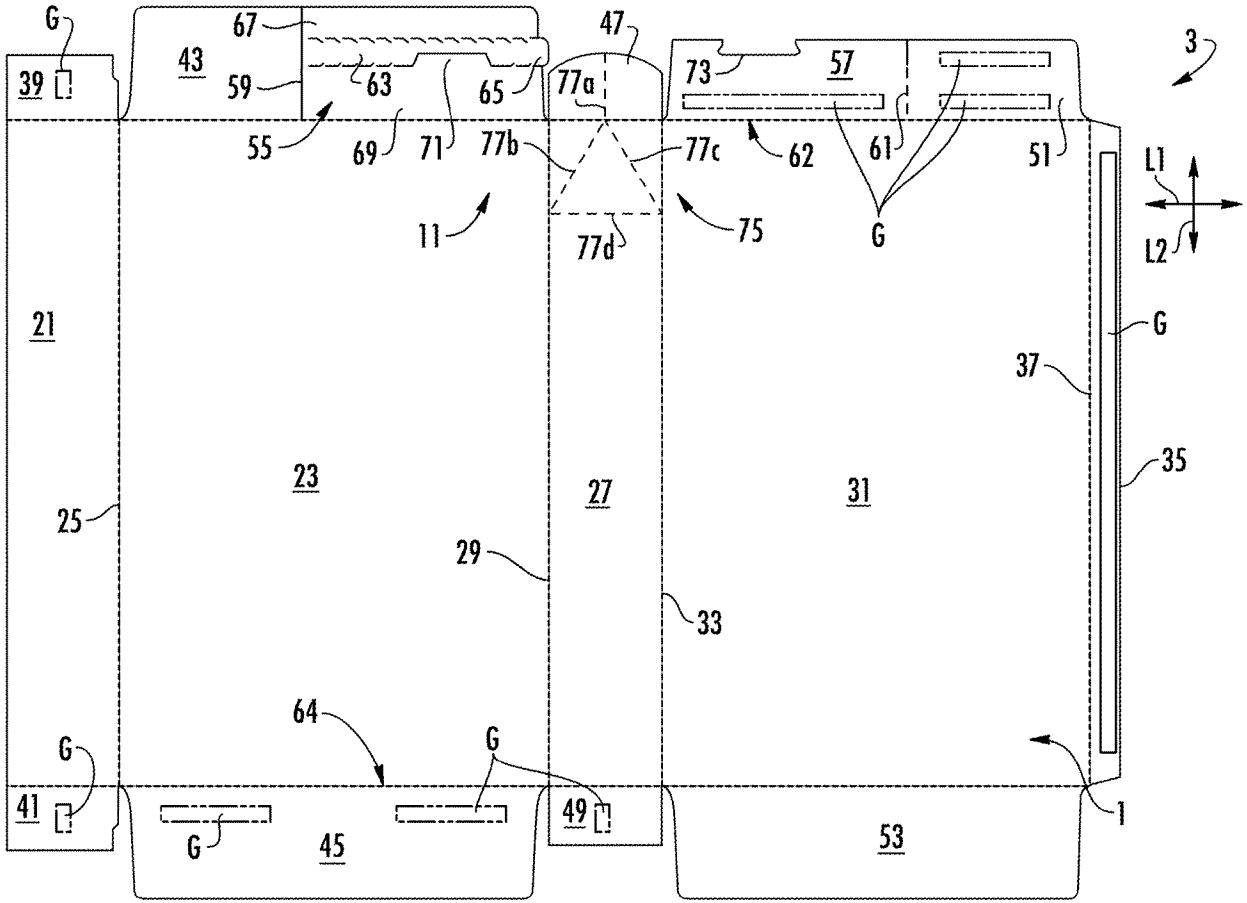
FIG. 1 is a plan view of a blank for forming a carton according to a first embodiment of the disclosure.
Figure 3:
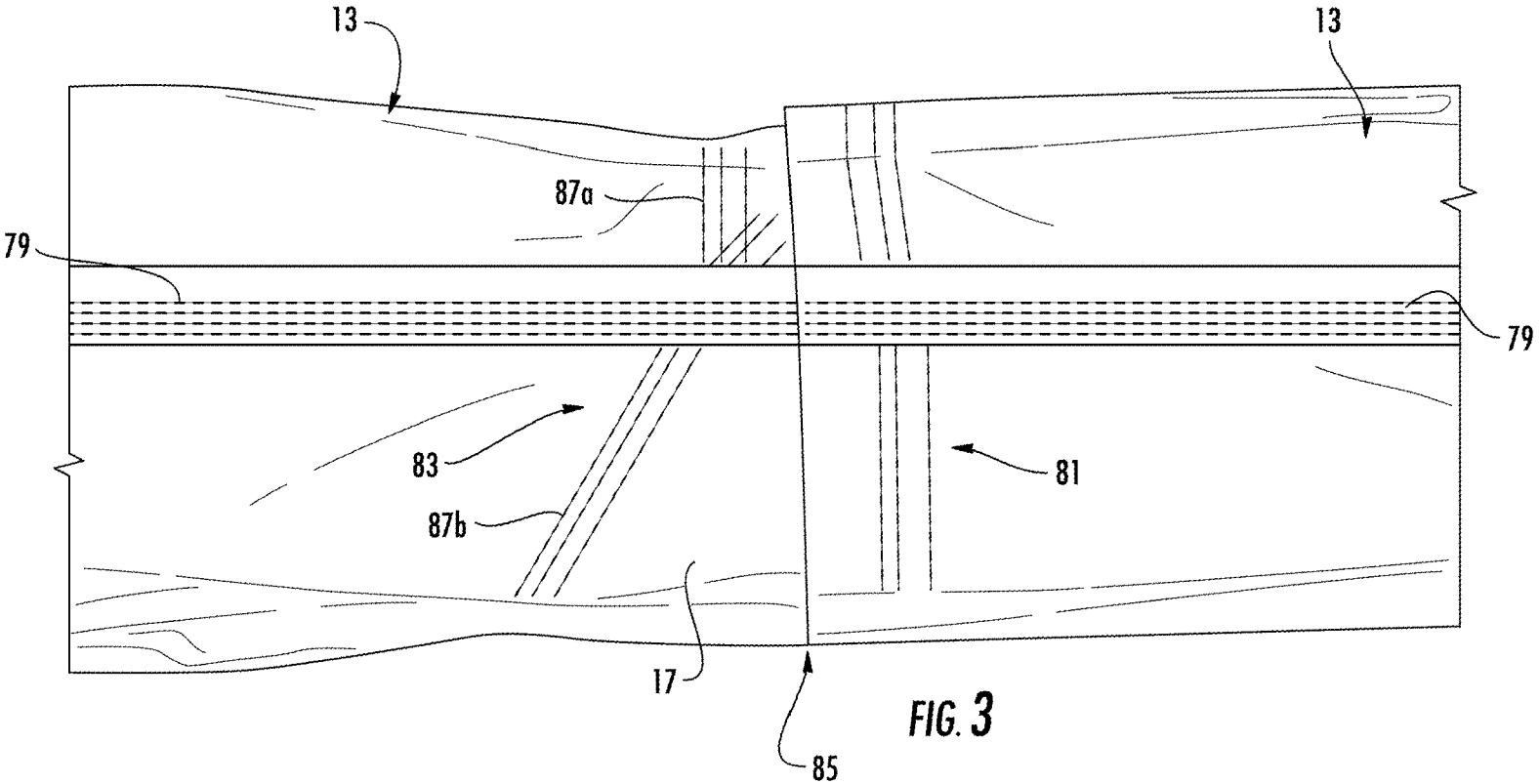
FIGS. 3-5 are perspective views of the bag of FIG. 2.
Figure 4:
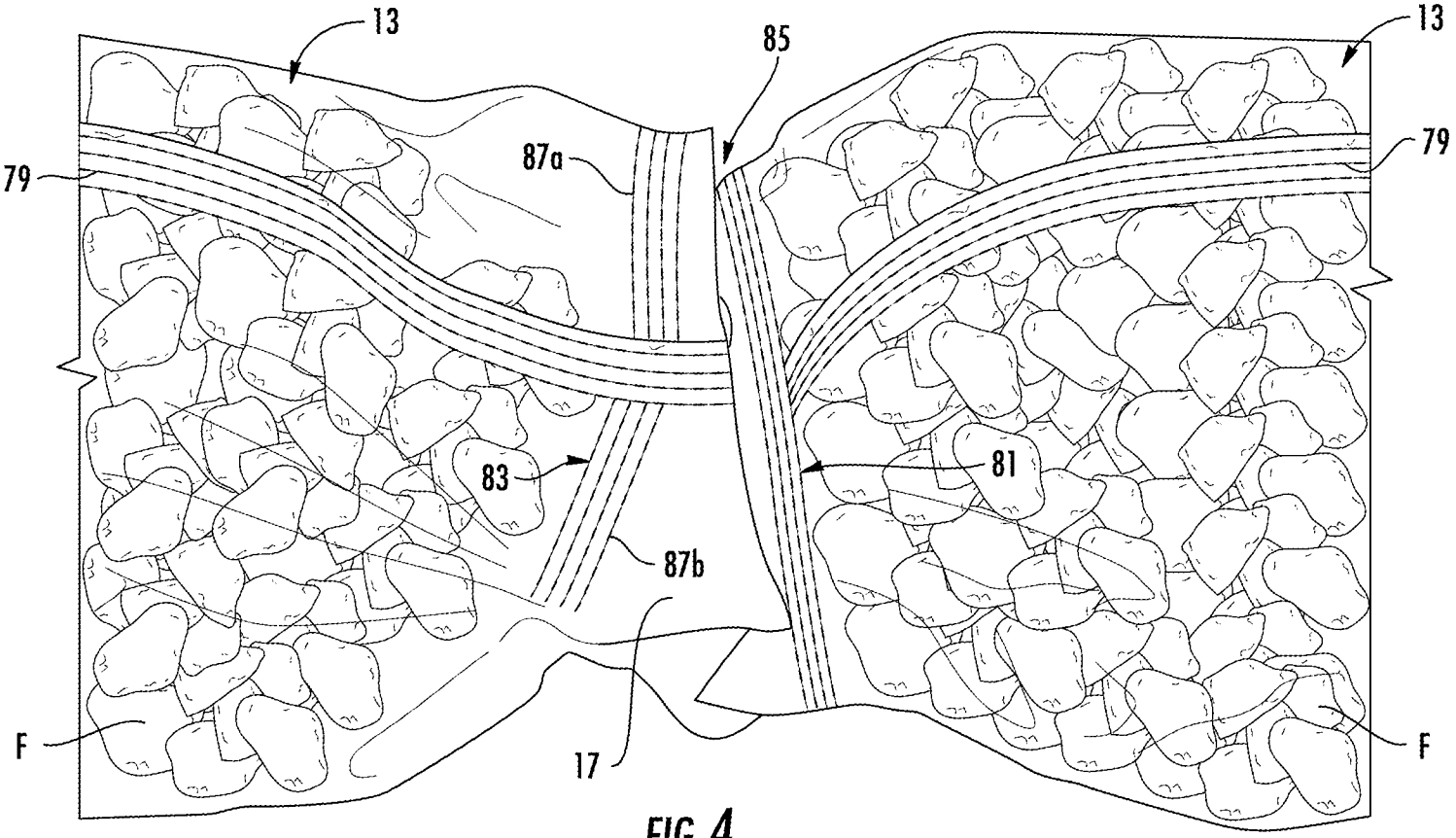
Figure 7:
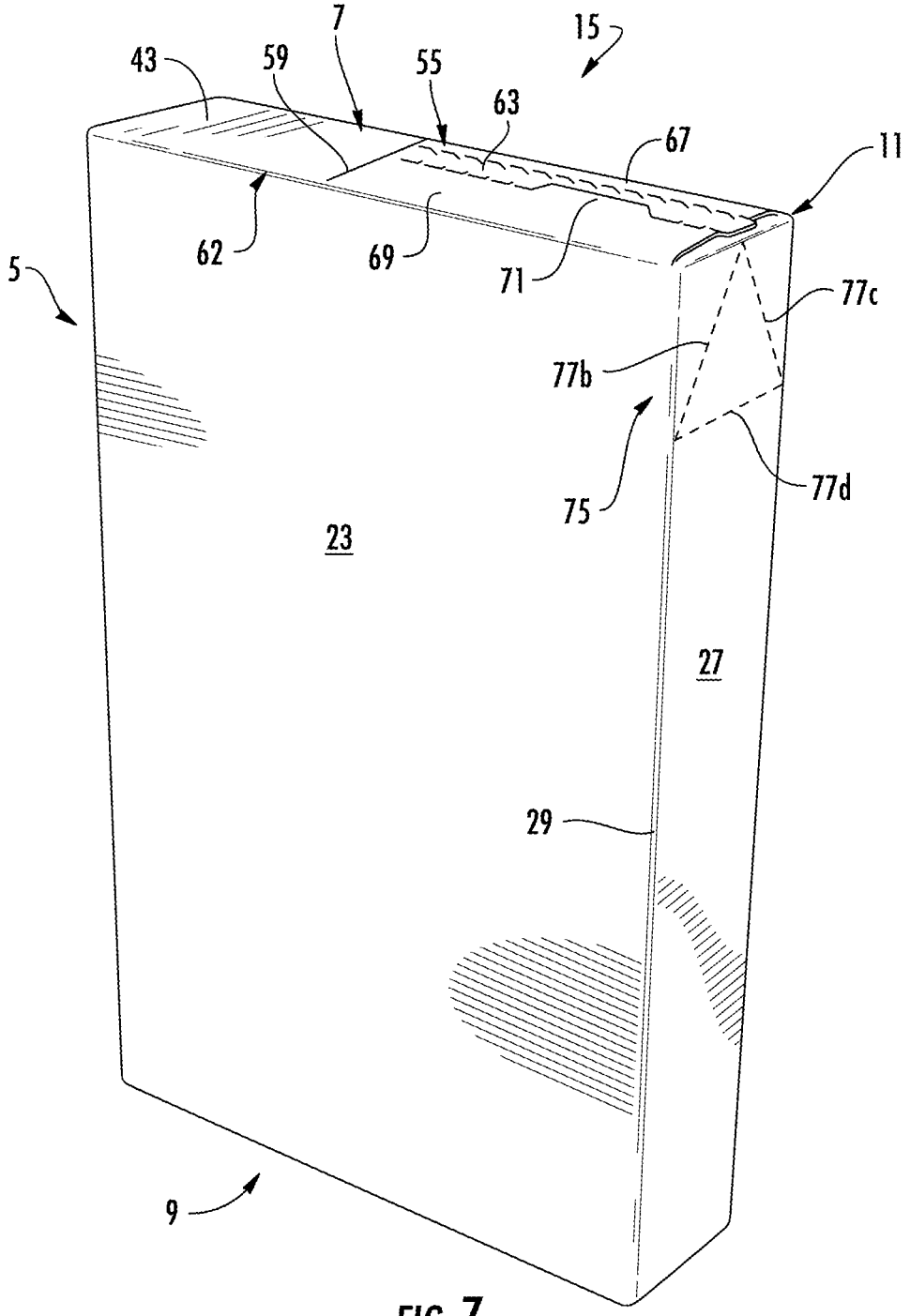
FIG. 7 is a perspective view of the erected carton according to the first embodiment of the disclosure.
Figure 8:
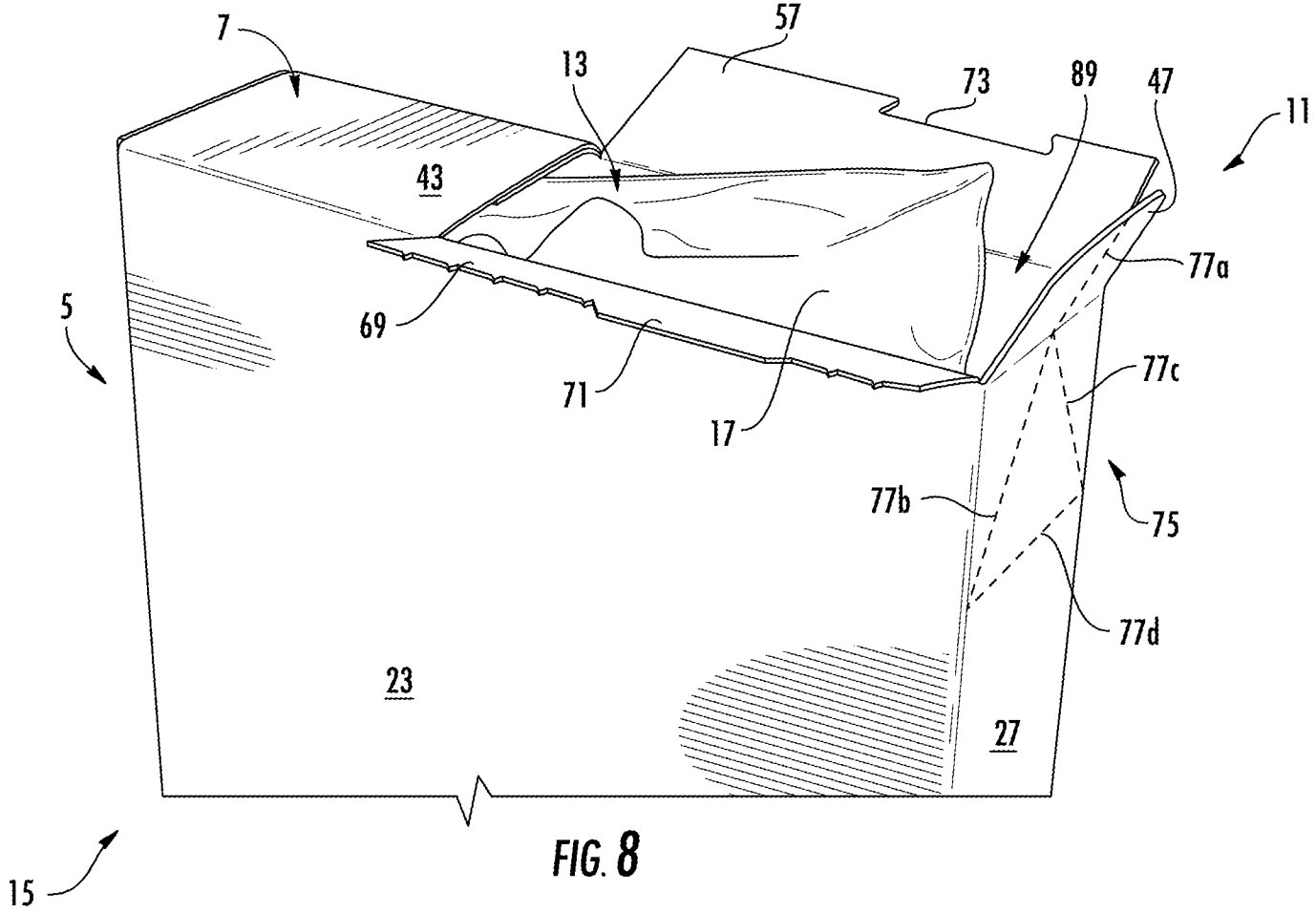
FIGS. 8 and 9 are perspective views of the carton of FIG. 7 with an open dispenser according to the first embodiment of the disclosure.
Figure 9:
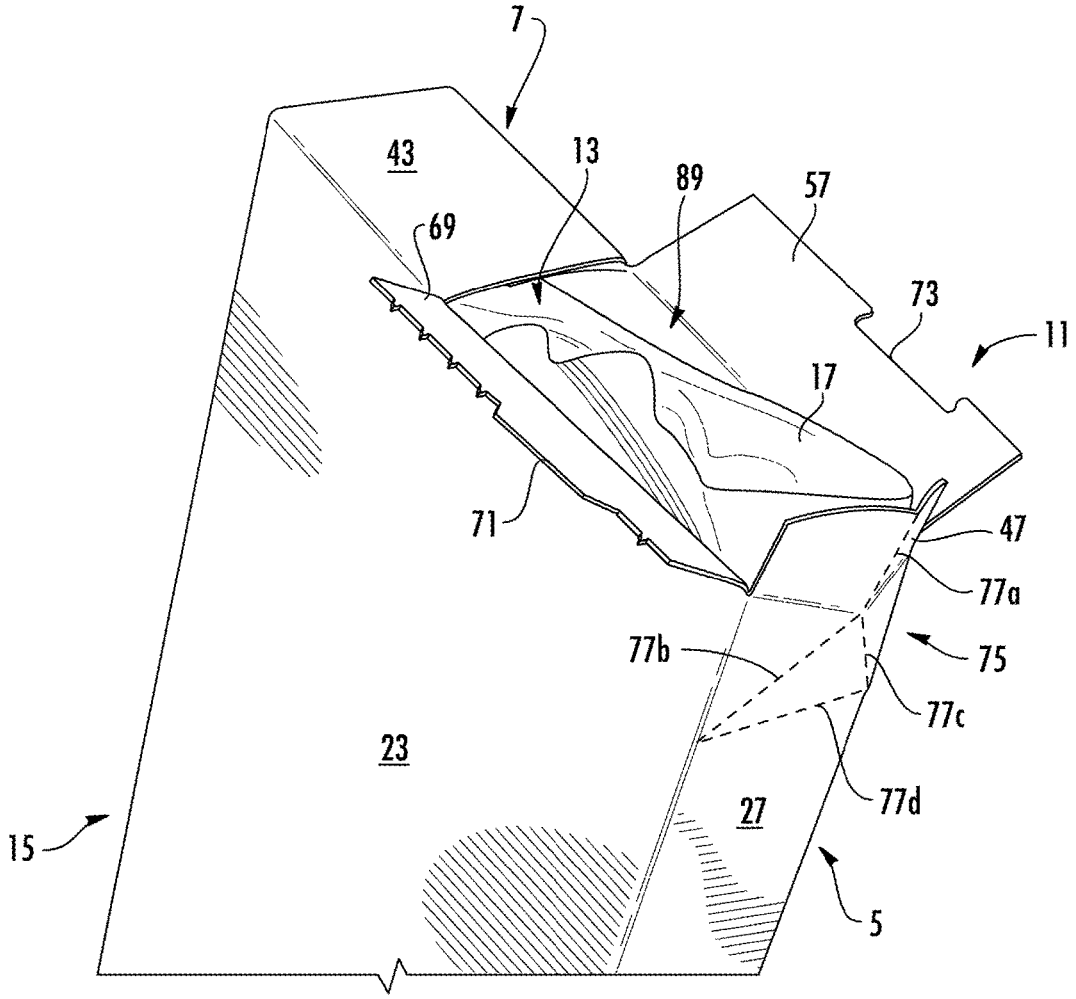

FIG. 1 is a plan view of the exterior side 1 of a blank, generally indicated at 3, used to form a carton 5 (FIG. 7) according to an exemplary first embodiment of the disclosure. The carton 5 can be used to house a flowable material F (e.g., a food product such as cereal as shown in FIG. 4) or other products. The carton 5 can have a top closed end 7 and a bottom closed end 9 (FIG. 7). In the illustrated embodiment, the carton 5 includes a dispenser, generally indicated at 11 (FIGS. 7-9) for dispensing product from within the carton at the top end 7 of the carton. A liner or bag 13 (FIGS. 2-6) can be disposed within the carton 5 to form a package 15 (FIGS. 7-9). In the illustrated embodiment, the bag 13 can include one or more dispenser features 17 for cooperating with the dispenser 11 of the carton 5 (FIGS. 8 and 9).

As shown in FIG. 1, the blank 3 has a longitudinal axis L1 and a lateral axis L2. In the illustrated embodiment, the blank 3 comprises a first end or back panel 21 foldably connected to a first side panel 23 at a first lateral fold line 25, a second end or front panel 27 foldably connected to the first side panel 23 at a second lateral fold line 29, and a second side panel 31 foldably connected to the front panel 27 at a third lateral fold line 33. In the illustrated embodiment, the blank 3 includes an attachment flap 35 foldably connected to the second side panel 31 at a fourth lateral fold line 37. Alternatively, the attachment flap 35 could be foldably connected to the back panel 21 or could be omitted without departing from the disclosure.

In the illustrated embodiment, the back panel 21 is foldably connected to a back top flap 39 and a back bottom flap 41. The first side panel 23 is foldably connected to a first side top flap 43 and a first side bottom flap 45. The front panel 27 is foldably connected to a front top flap 47 and a front bottom flap 49. The second side panel 31 is foldably connected to a second side top flap 51 and a second side bottom flap 53. The top flaps 39, 43, 47, and 51 extend along a first or top marginal area of the blank 3. The back top flap 39 is foldably connected to the back panel 21, the first side top flap 43 is foldably connected to the first side panel 23, the front top flap 47 is foldably connected to the front panel 27, and the second side top flap 51 is foldably connected to the second side panel 31 along a first longitudinal extending fold line 62 that extends along the length of the blank. The bottom flaps 41, 45, 49, 53 extend along a second or bottom marginal area of the blank 3. The bottom flaps 41, 45, 49, 53 are foldably connected to the respective panels 21, 23, 27, 31 along a second longitudinally extending fold line 64 that extends along the length of the blank. In one embodiment, the longitudinal fold lines 62, 64 may be, for example, substantially straight, or offset at one or more locations to account for blank thickness or for other factors. When the carton 5 (FIG. 7) is erected, the top end flaps 39, 43, 47, 51 can at least partially close the top end 7 of the carton 5, and the bottom end flaps 41, 45, 49, 53 can at least partially close the bottom end 9 of the carton 5.

As shown in FIG. 1, the dispenser features that form the dispenser 11 in the illustrated embodiment can include a first dispenser flap 55 and a second dispenser flap 57, which can be foldably connected to the respective first side panel 23 and second side panel 31 along the longitudinal fold line 62. In one embodiment, the first dispenser flap 55 can be separable from the first side top flap 43 along a tear or cut line 59, and the second dispenser flap 57 can be separable from the second side top flap 51 along a cut or tear line 61. The dispenser features can also include a tear strip 63 with a starting tab 65. The tear strip 63 can be defined by two, spaced apart tear lines extending in the first dispenser flap 55. As shown in FIG. 1, the first dispenser flap 55 can include a distal or glue portion 67 between the tear strip 63 and the outer edge of the first dispenser flap 55, and the remainder of the first dispenser flap 55 after removing the tear strip 63 to open the dispenser 11 (FIGS. 8 and 9) forms a reclosable flap 69 with a closing tab 71. As shown in FIG. 1, the second dispenser flap 57 can include a notch 73 for receiving the closing tab 71 when closing the dispenser 11 after removing the tear strip 63.

In the illustrated embodiment, the dispenser 11 can also include features for forming a spout 75 (FIG. 9) when the dispenser 11 is opened. As shown in FIG. 1, the spout features can include a lateral fold line 77*a* generally bisecting the front top flap 47, two oblique fold lines 77*b*, 77*c* extending from an end of the lateral fold line 77*a* (e.g., at the intersection of the lateral fold line 77*a* and the longitudinal fold line 62), and a longitudinal fold line 77*d* extending from the ends of the oblique fold lines 77*b*, 77*c* (e.g., at the intersection of the fold lines 77*b*, 77*c* and the respective lateral fold lines 29, 33). Accordingly, as shown in FIG. 9, the front panel 27 and/or the front top flap 47 can fold along the fold lines 29, 33, 77*a*, 77*b*, 77*c*, 77*d* at the spout 75 to generally form a shape that can help direct the flowable material F as it is poured out of the package 15 at the spout 75. Any of the dispenser features, including the dispenser flaps 55, 57 and/or the spout 75, could be omitted or could be otherwise shaped, arranged, positioned, and/or configured, without departing from the disclosure.

Figure 2:
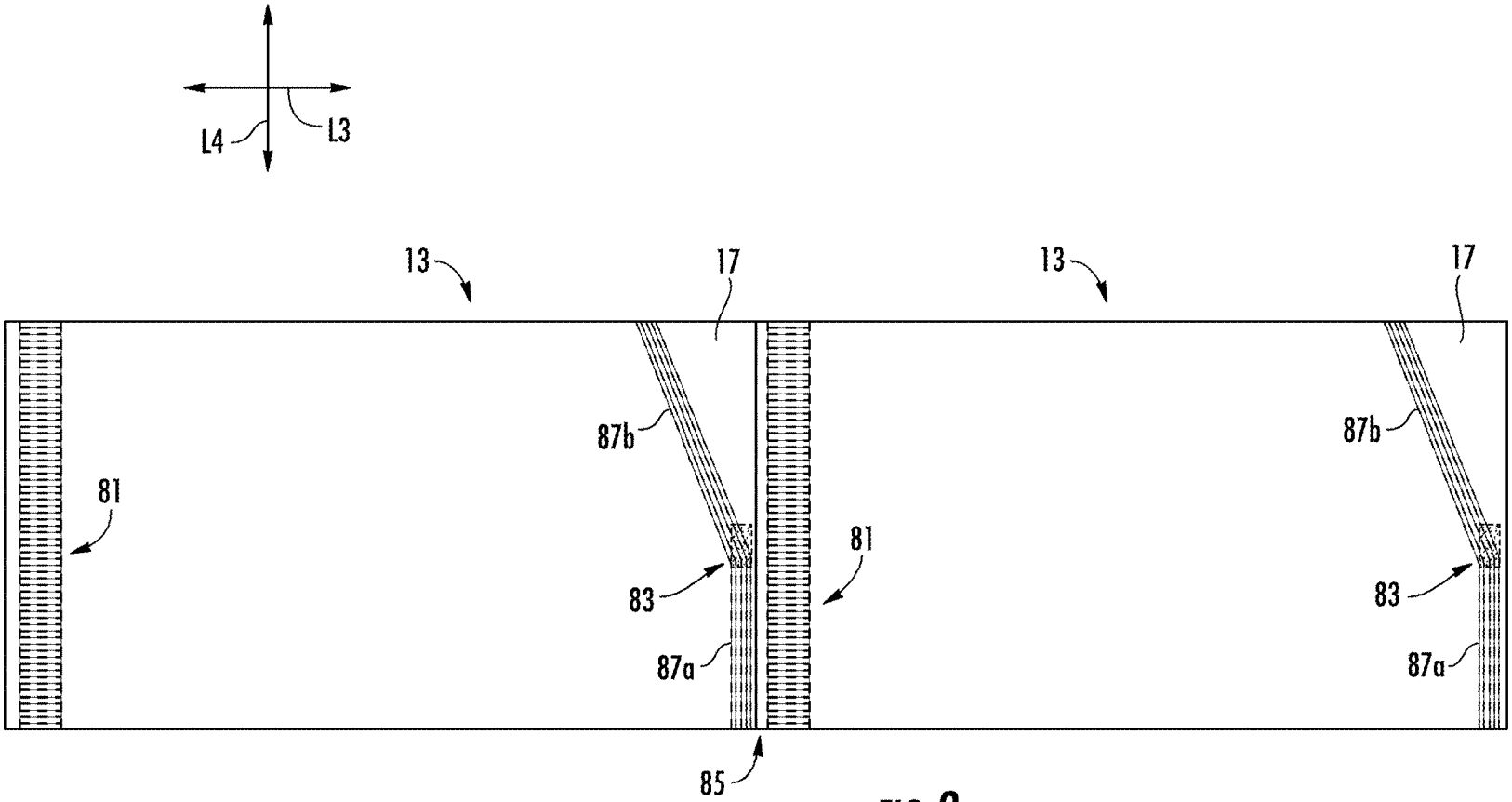
FIG. 2 is a schematic plan view of a bag or liner for being disposed in the carton according to the first embodiment of the disclosure.
Figure 5:
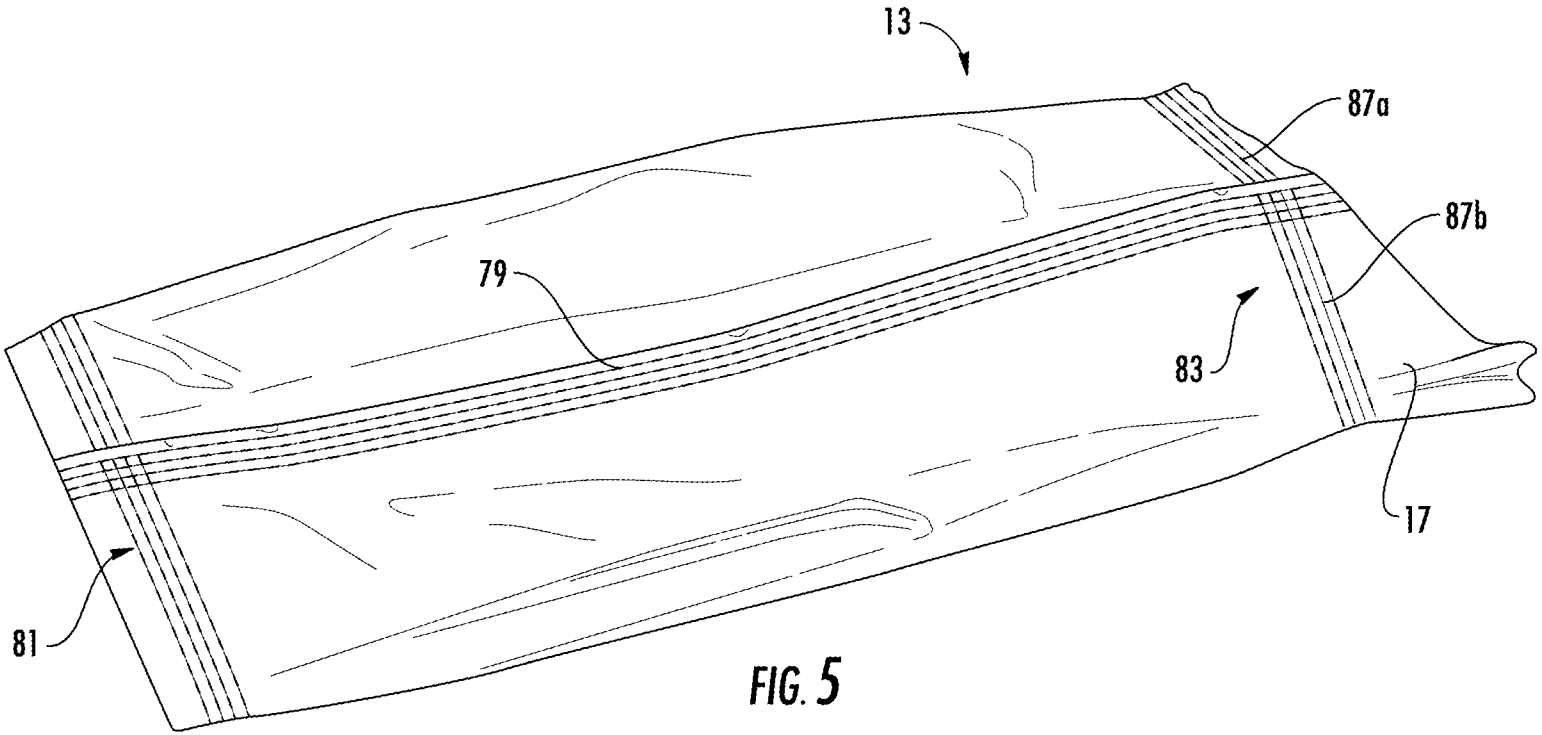

As schematically shown in FIG. 2, two or more bags 13 can be formed in series and can have a longitudinal axis L3 and a lateral axis L4. For example, in one embodiment, the bags 13 can be formed in a generally tubular length of material (e.g., plastic or any other suitable material). The tubular material could be formed by folding a sheet of material and securing the marginal portions along the length of the bag together to form a longitudinal seam 79 (FIGS. 3-5). The seam 79 can be secured by gluing, welding (e.g., ultrasonic welding, heat welding, radio frequency welding, etc.), and/or any other suitable method. Each bag 13 can be have a respective bottom seal 81 and a top seal 83, wherein the sidewalls of the bag can be secured together at the respective top and bottom of the bag by gluing, welding (e.g., ultrasonic welding, heat welding, radio frequency welding, etc.), and/or any other suitable method. Additionally, each bag 13 can be separated from the respectively adjacent bags along a cut 85. In one embodiment, the bottom seal 81 of one bag 13, the top seal 83 of an adjacent bag 13, and the cut 85 between the two bags can be formed simultaneously or in a sequence.

As shown in FIGS. 2-5, the top seal 83 of each bag 13 can include a lateral portion 87*a* and an oblique portion 87*b*. Accordingly, the oblique portion 87*b* of the top seal 83 can form the dispenser feature 17 in the bag 13. For example, the oblique portion 87*b* can form a larger area adjacent one of the top corners of the bag 13 where the sidewalls of the bag are not secured together (e.g., are free from connection to one another) above the top seal 83. When aligned with the dispenser 11 (e.g., FIGS. 8 and 9), the dispenser feature 17 can provide a portion of the bag that is accessible through the dispenser 11 in the carton 5 where a user can easily grasp the sidewalls of the bag to pull the sidewalls apart and at least partially separate the sidewalls from one another along at least the oblique portion 87*b* of the top seal 83 to at least partially open the bag.

In the illustrated embodiment, each bag 13 can be filled with flowable material F (e.g., cereal; FIG. 4) before, during, or after sealing the respective bag at the top and/or the bottom. The bag 13 could be otherwise formed and/or any of the features of the bag 13 could be otherwise shaped, arranged, positioned, and/or configured, without departing from the disclosure. For example, the bag used in the package 15 could be any suitable bag. In one embodiment, the bag used in the package 15 could be any suitable bag or liner wherein at least a portion of a seal is oblique with respect to a top of the bag to at least partially form a dispenser feature 17.

Figure 6:
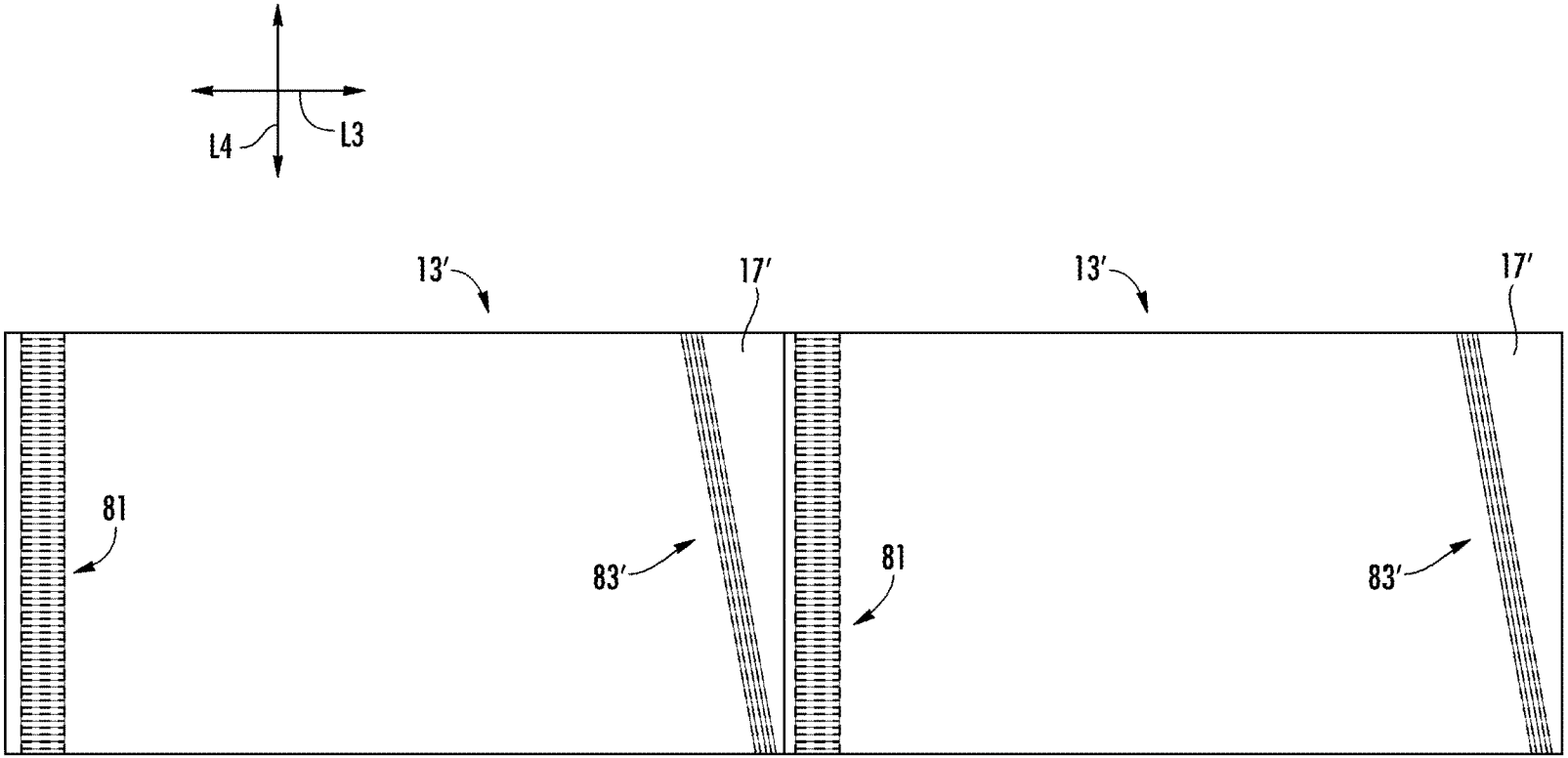
FIG. 6 is a schematic plan view of an alternative bag or liner.

In an alternative embodiment, shown schematically in FIG. 6, the alternative bags 13' each have an alternative top seal 83', which is oblique along its entire length. Accordingly, each of the bags 13' has a longer dispenser feature 17' that tapers from one top corner of the bag to the other.

According to one exemplary method of construction, the carton 5 may be erected by folding the blank 3 about the lateral fold lines 25, 29, 33, 37 so that the attachment flap 35 is adhesively secured to or otherwise attached to the back panel 21 (e.g., by a glue strip G; FIG. 1), and the blank 3 is formed into a generally open-ended sleeve (not shown) with an interior 89 (FIGS. 8 and 9). In one embodiment the bottom of the partially erected carton 5 can be closed by folding the bottom flaps 41, 45, 49, 53 inwardly, to at least partially overlap the bottom end flaps and close the bottom end 9 of the carton 5. In one embodiment, the first side bottom flap 45 can overlap the back and front bottom flaps 41, 49 and can be glued to the same (e.g., by glue strips G; FIG. 1), and the second side bottom flap 53 can overlap the first bottom closure flap 45 and can be glued to the same (e.g., by glue strips G; FIG. 1).

Similarly, the top 9 of the carton 5 can be closed by folding and at least partially overlapping the top flaps 39, 43, 47, 51, 55, 57. As shown in FIG. 7, the flaps 51, 57, which are connected at the tear line 61, are folded over the top of the carton 5 to overlap the respective back and front top flaps 39, 47, and the back top flap 39 can be glued to the second side top flap 51 (e.g., at a glue strip G; FIG. 1). In one embodiment, the front top flap 47 is not glued to the second dispenser flap 57. The flaps 43, 55 can be folded over to overlap the respective flaps 51, 57. In the illustrated embodiment, the first side top flap 43 can be glued to the second side top flap 51 (e.g., by glue strips G; FIG. 1), and the glue portion 67 of the first dispenser flap 55 can be glued to the second dispenser flap 57 (e.g., by glue strips G; FIG. 1). In one embodiment, the tear strip 63 and the reclosable flap 69 of the first dispenser flap 55 are not glued to the second dispenser flap 57. The erected carton 5 is shown in FIG. 7. The carton 5 could be otherwise formed without departing from the disclosure.

In one embodiment, the bag 13 with a product such as the flowable material F (FIG. 4) may be placed in the interior space of the partially formed carton 5 (e.g., before either or both of the ends 7, 9 is closed). The bag 13 can be loaded and/or sealed prior to, during, or after the bag is loaded into the carton 5. The bag 13 and/or the product can be otherwise loaded and/or inserted into the carton 5 without departing from the disclosure. For example, in one embodiment, the carton 5 could be formed around a formed or partially formed bag 13. The assembled package 15 is shown in FIGS. 7-9.

In the illustrated embodiment, the dispenser 11 is positionable between an initially closed position (FIG. 7) and an open or dispensing position (FIGS. 8 and 9) that provides access to the products held in the carton 5. Additionally, the dispenser 11 includes features that allow the dispenser to be closed (e.g., reclosed) after access to the products is no longer needed. To activate the dispenser 11, the tear strip 63 is first torn and removed so that the reclosable lid flap 69 is free from attachment to the distal or glue portion 67 of the first dispenser flap 55, wherein the distal portion 67 is adhesively attached to the second dispenser flap 57. After removing the tear strip 63, the reclosable lid flap 69 can be pivoted upwardly about the longitudinal fold line 62, separating the first dispenser flap from the first side top flap 43 along the cut or tear line 59. The second dispenser flap 57 also can be separated from the second side top flap 51 along the tear line 61 and pivoted upwardly about the longitudinal fold line 62. As shown in FIGS. 8 and 9, the front top flap 47 can be pivoted upwardly along the longitudinal fold line 62 so that the dispenser 11 is in the open position providing access to the interior 89 of the carton 5. The dispenser 11 could be otherwise opened without departing from the disclosure.

As shown in FIGS. 8 and 9, the dispenser feature 17 of the bag 13 in the interior 89 of the carton 5 can be accessed via the open dispenser 11. A user can grasp the sidewalls of the bag 13 in the dispenser feature 17, and pull the sidewalls apart to separate the sidewalls along at least a portion of the top seal 83 to open the bag 13 at the dispenser feature 17. The flowable material F in the bag 13 can be poured and/or otherwise removed from the package 15 through the opened dispenser feature 17 in the bag and the open dispenser 11 in the carton 5 such as by tipping the package 15 (FIG. 9). The spout 75 can be shaped to help direct the pouring of the flowable material F. For example, in one embodiment, the side panels 23, 31 of the carton 5 can be squeezed together slightly, which can cause the front top flap 47 and/or the front panel 27 to fold along the fold lines 77*a*, 77*b*, 77*c*, 77*d* as shown in FIG. 9. As shown in FIGS. 8 and 9, the top end 7 of the carton 5 remains closed where the back top flap 39, the first side top flap 43, and the second side top flap 51 overlap even when the dispenser 11 is open. Accordingly, the overlapped flaps 39, 43, 51 can help retain the bag 13 in the interior 89 of the carton 5 while the package 15 is tipped to dispenser the flowable material F. The flowable material F could be otherwise removed from the package 15 without departing from the disclosure.

In the illustrated embodiment, the dispenser 11 can be moved to a closed position after the initial opening. For example, the front top flap 47, the second dispenser flap 57 and the reclosable flap 69 can be folded along the longitudinal fold line 62 so that the reclosable flap 69 partially overlaps the second dispenser flap 57. The closing tab 71 can be inserted into the notch 73 and tucked under the edge of the second dispenser flap 57 to help retain the dispenser 11 in the closed position. Subsequently, the dispenser 11 could be opened by pivoting the flaps 69, 57, 47 upwardly. The dispenser 11 could be otherwise repositioned between the open and closed positions without departing from the disclosure.

Figure 10:
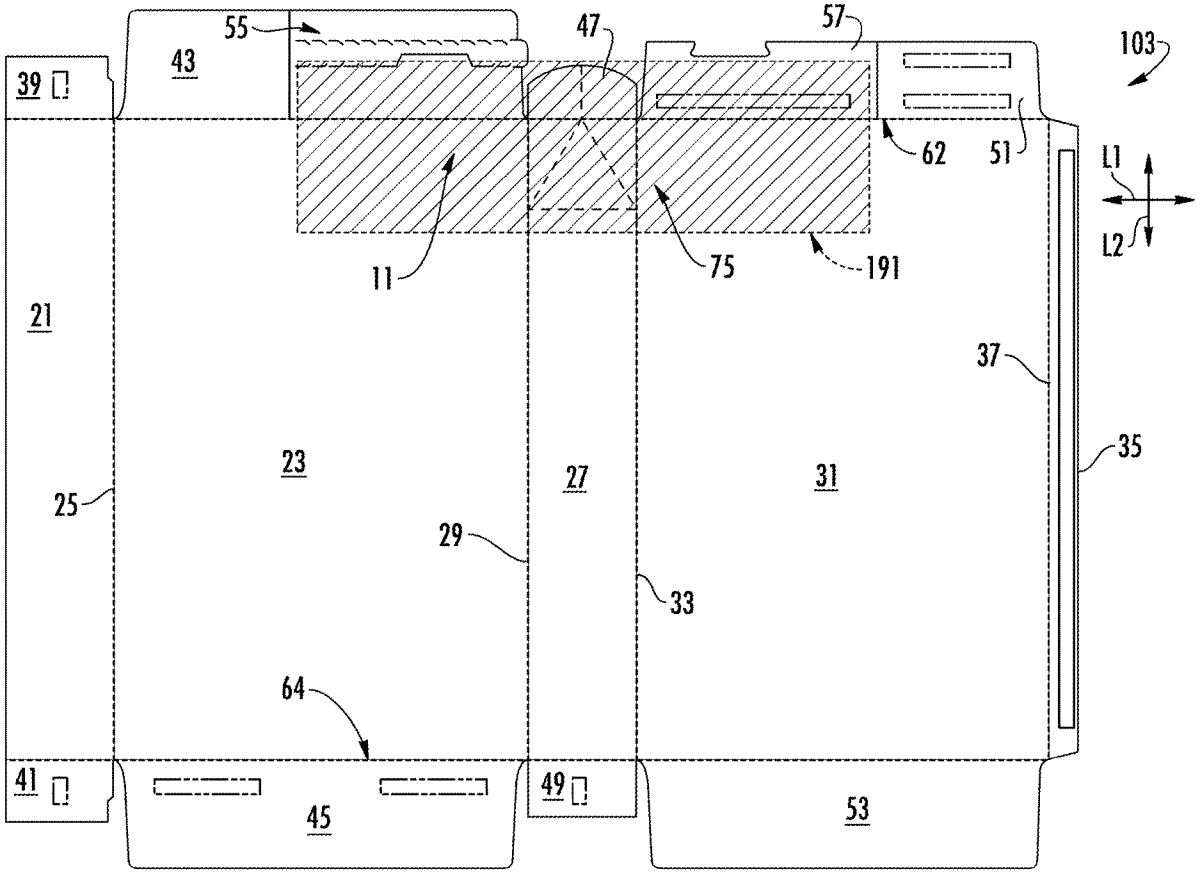
FIG. 10 is a plan view of a blank for forming a carton according to a second embodiment of the disclosure.

FIG. 10 is a plan view of a blank 103 for forming a carton 105 and a package 115 (FIGS. 11 and 12) of a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 10, a liner patch 191 (e.g., comprising paper, foil, polymer film, and/or laminates and/or other combinations thereof) can be attached to the blank 103. For example, the liner patch 191 can overlap portions of the side panels 23, 31, the front panel 27, the first and second dispenser flaps 55, 57, and the front top flap 47. In one embodiment, the liner patch 191 is glued to these panels and flaps or to a portion thereof. In the second embodiment, the liner patch 191 is glued and/or otherwise secured to an interior surface of the blank 103. While FIG. 10 shows an exterior view of the blank 103, the liner patch 191 is visible through the blank 103 for the purpose of illustration. The liner patch 191 could be otherwise shaped, arranged, positioned, and/or configured, without departing from the disclosure.

Figure 11:
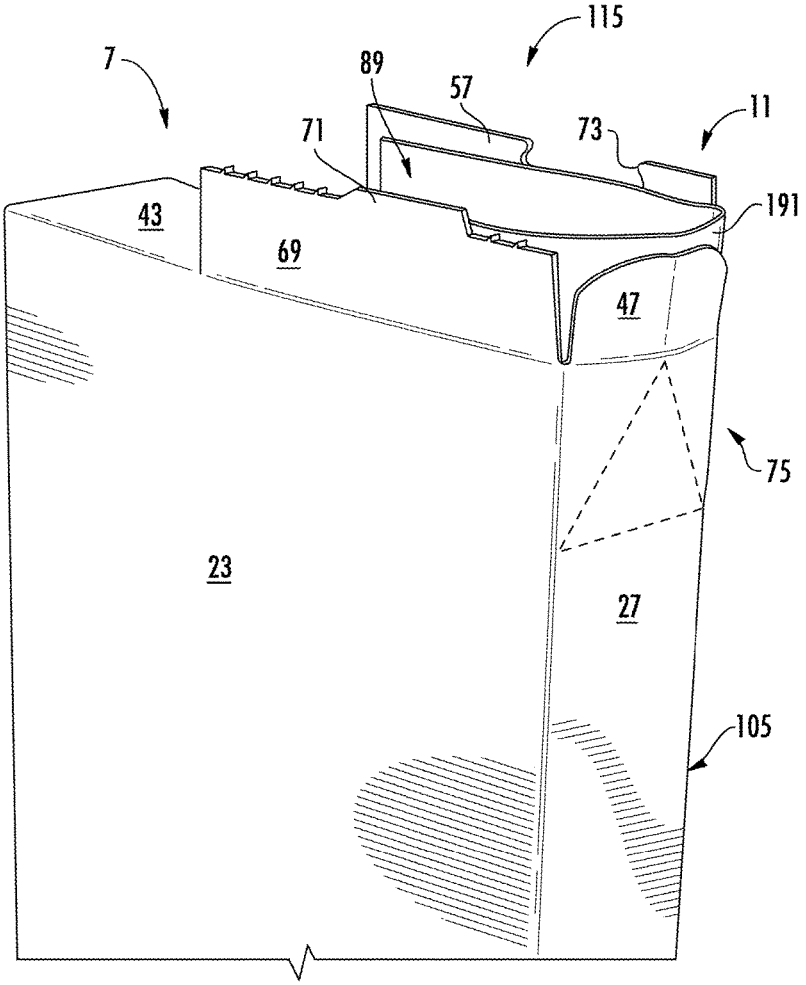
FIGS. 11 and 12 are perspective views of the erected carton with an open dispenser according to the second embodiment of the disclosure.
Figure 12:
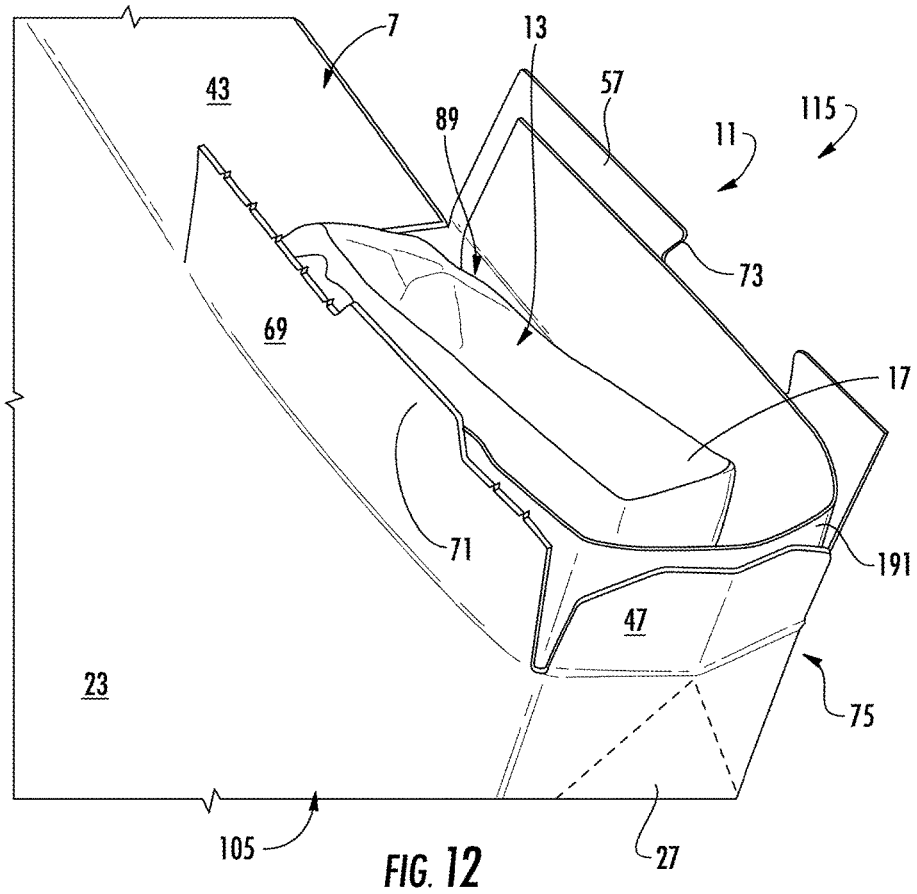

As shown in FIGS. 11 and 12, the liner patch 191 can form a barrier in the open dispenser 11 that can help protect the flowable material F while it is poured through the dispenser and/or can provide a smooth continuous surface around the interior of the flaps 47, 57, 69 at the open dispenser 11. Accordingly, the liner patch 191 extends from the interior 89 of the carton 5 through the dispenser 11. The liner patch 191 can help guide the flowable material F through the dispenser 11 as it is poured from the package 115, and it can help to improve sift resistance and reduce clumping and bridging of the flowable material in the dispenser 11. In one embodiment, the closing the dispenser 11 can form a gusset in the liner patch 11. For example, as the flaps 47, 57, 69 are folded downwardly portions of the liner patch 191 are overlapped (e.g., in a triangle shape). Accordingly, the liner patch 191 can help to reduce leaking of the product through the reclosed dispenser 11.

Figure 13:
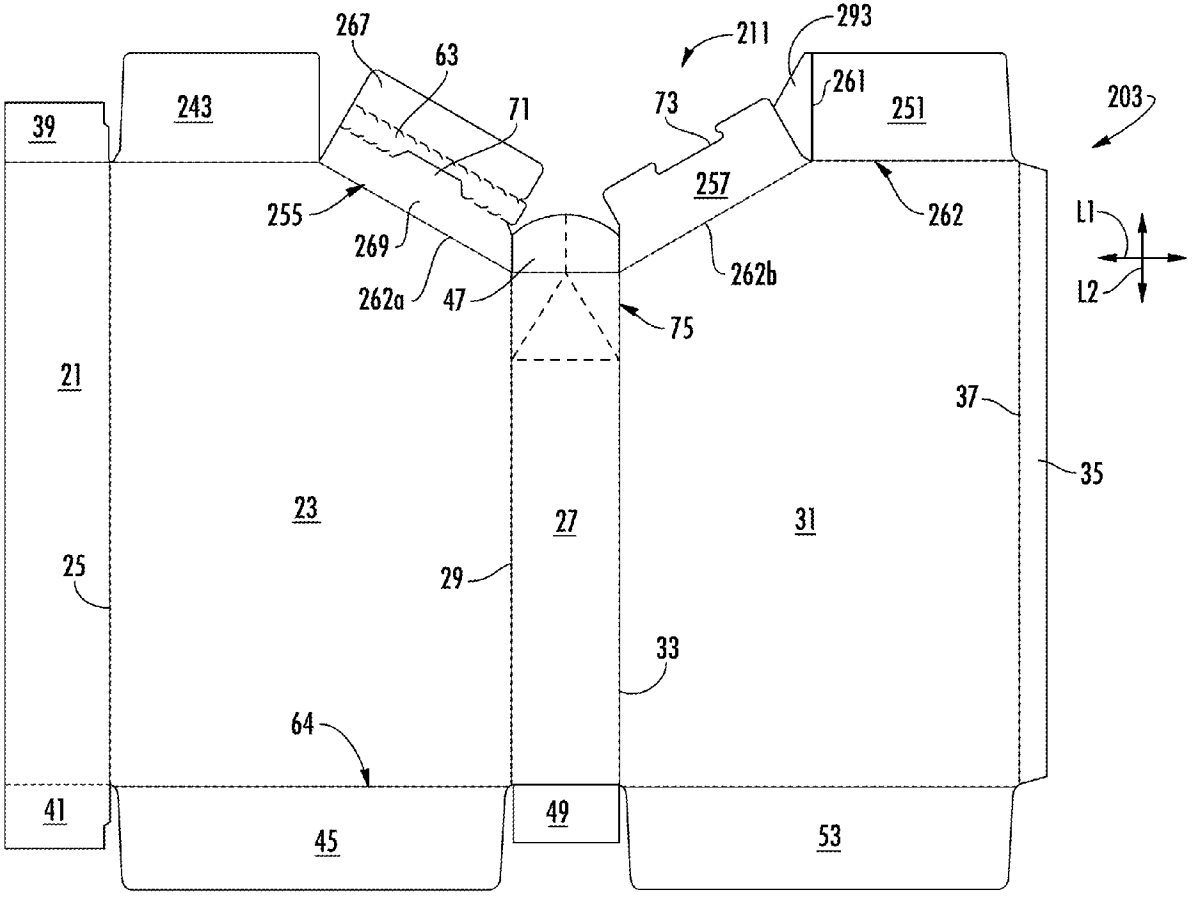
FIG. 13 is a plan view of a blank for forming a carton according to a third embodiment of the disclosure.
Figure 14:
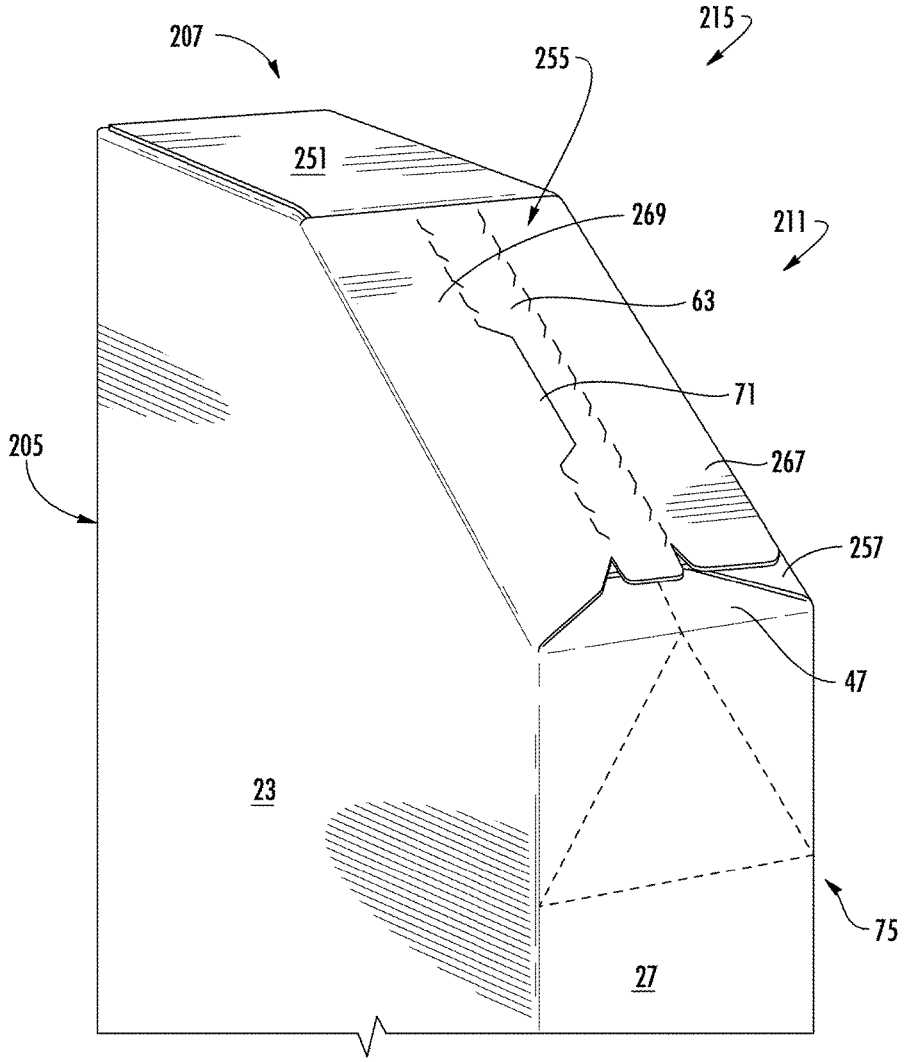
FIG. 14 is a perspective view of the erected carton according to the third embodiment of the disclosure.
Figure 15:
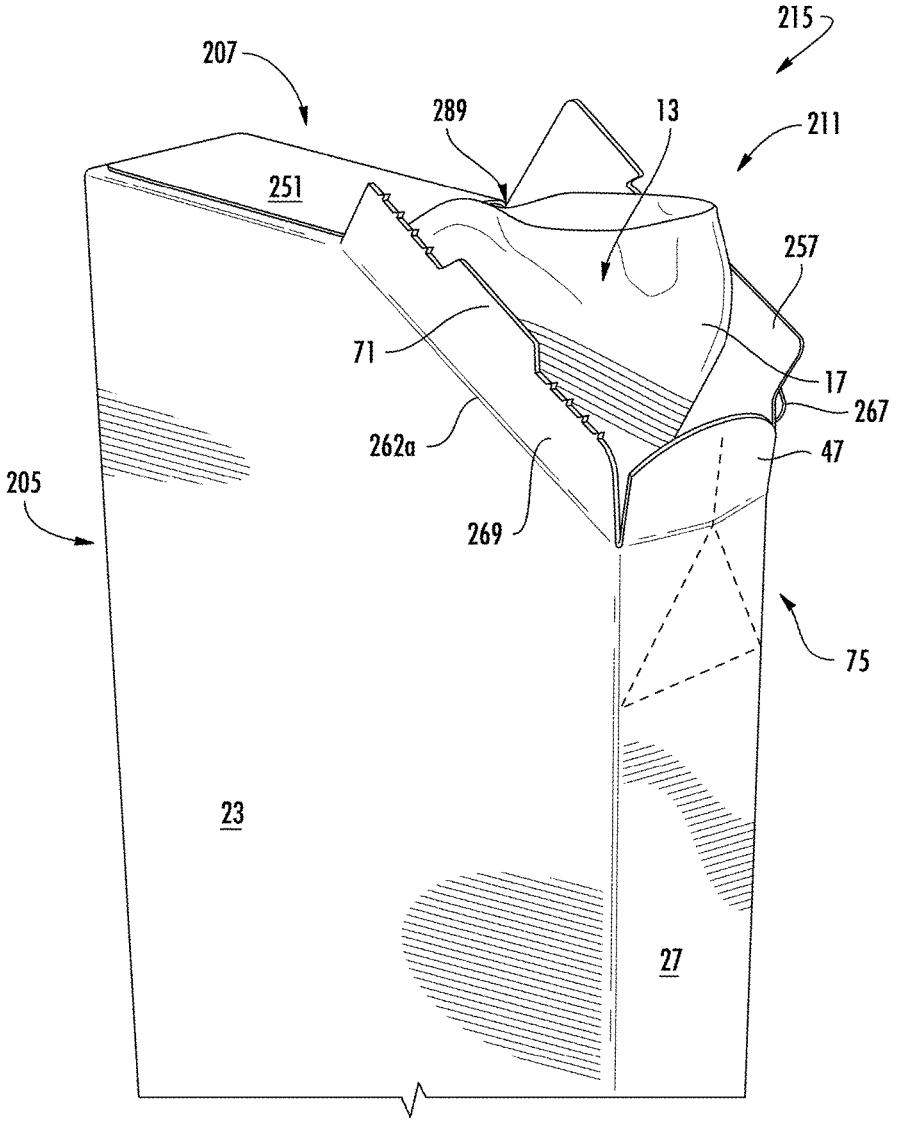
FIG. 15 is a perspective view of the carton of FIG. 14 with an open dispenser according to the third embodiment of the disclosure.
Figure 16:
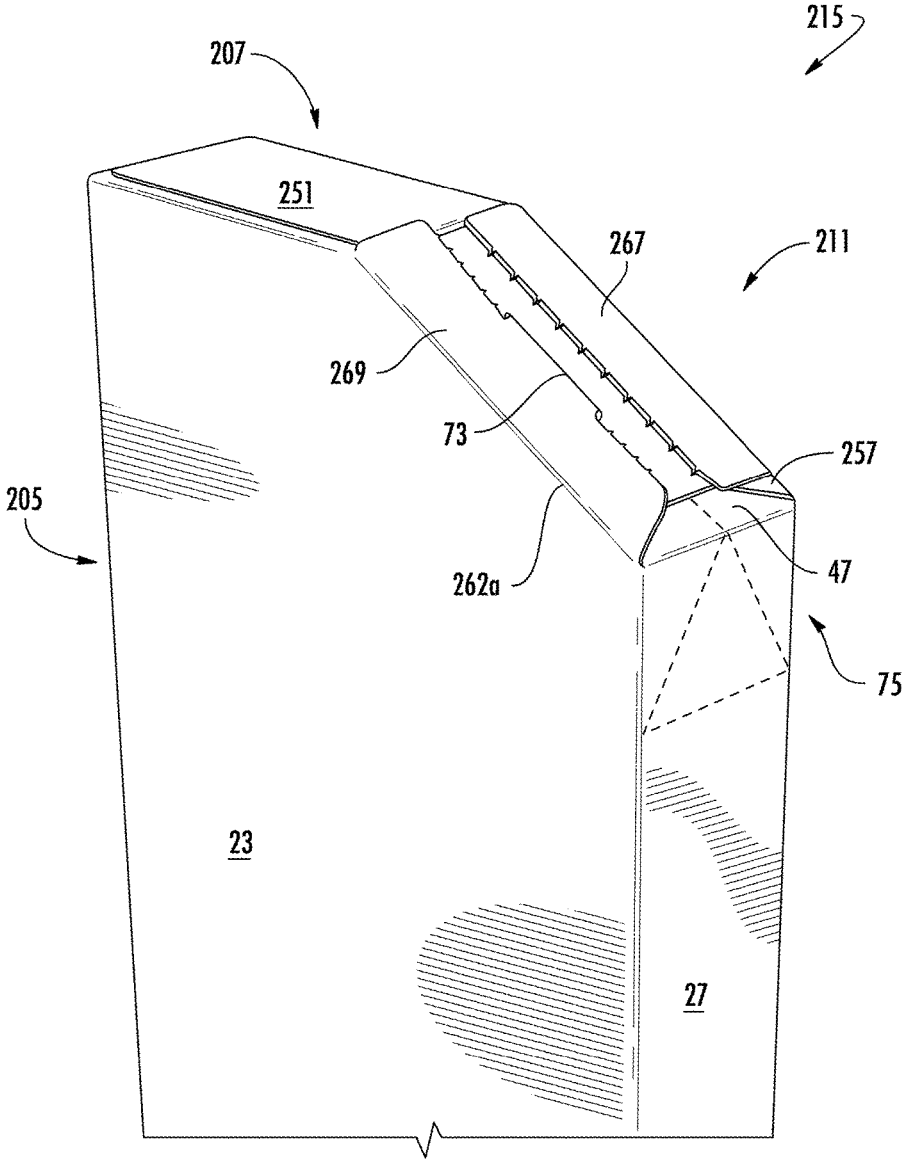
FIG. 16 is a perspective view of the carton of FIG. 14 with a reclosed dispenser according to the third embodiment of the disclosure.

FIG. 13 is a plan view of a blank 203 for forming a carton 205 and a package 215 (FIGS. 14-16) of a third embodiment of the disclosure. The third embodiment is generally similar to the first embodiment, except for variations noted and variations that will be apparent to one of ordinary skill in the art. Accordingly, similar or identical features of the embodiments have been given like or similar reference numbers. As shown in FIG. 13, the blank 203 includes features for forming a dispenser 211 that extends in an oblique direction between the top 207 and the front panel 27 (FIGS. 14-16). In the illustrated embodiment, the portions 262*a*, 262*b* of the fold line 262 that connect the respective dispenser flaps 255, 257 to the respective side panels 23, 31 are oblique so that the front top flap 47 is recessed with respect to the side top flaps 243, 251. The dispenser flaps 255, 257 can be separated from the respective side top flaps 243, 251, and a tab 293 can be foldably connected to the second side top flap 251 along a fold line 261. The blank 203 could be otherwise shaped, arranged, positioned, and/or configured, without departing from the disclosure.

When the carton 205 is formed (e.g., in the same or a similar manner as in the first embodiment), the dispenser 211 extends obliquely in the front, top corner of the carton. The second dispenser flap 257 generally overlaps the front top flap 47 and the tab 293, and the first dispenser flap 255 generally overlaps the second dispenser flap 257. The glue portion 267 of the first dispenser flap 255 can be glued to the second dispenser flap 257. In the illustrated embodiment, the dispenser 211 can be opened (FIG. 15) and closed (FIG. 16) in a similar or the same manner as the dispenser 11 of the first embodiment. In one embodiment, the oblique configuration of the dispenser 211 can help provide differentiation of the package 215 on a store shelf. The carton 205 and/or the dispenser 211 could be otherwise formed without departing from the disclosure.

Figure 17:
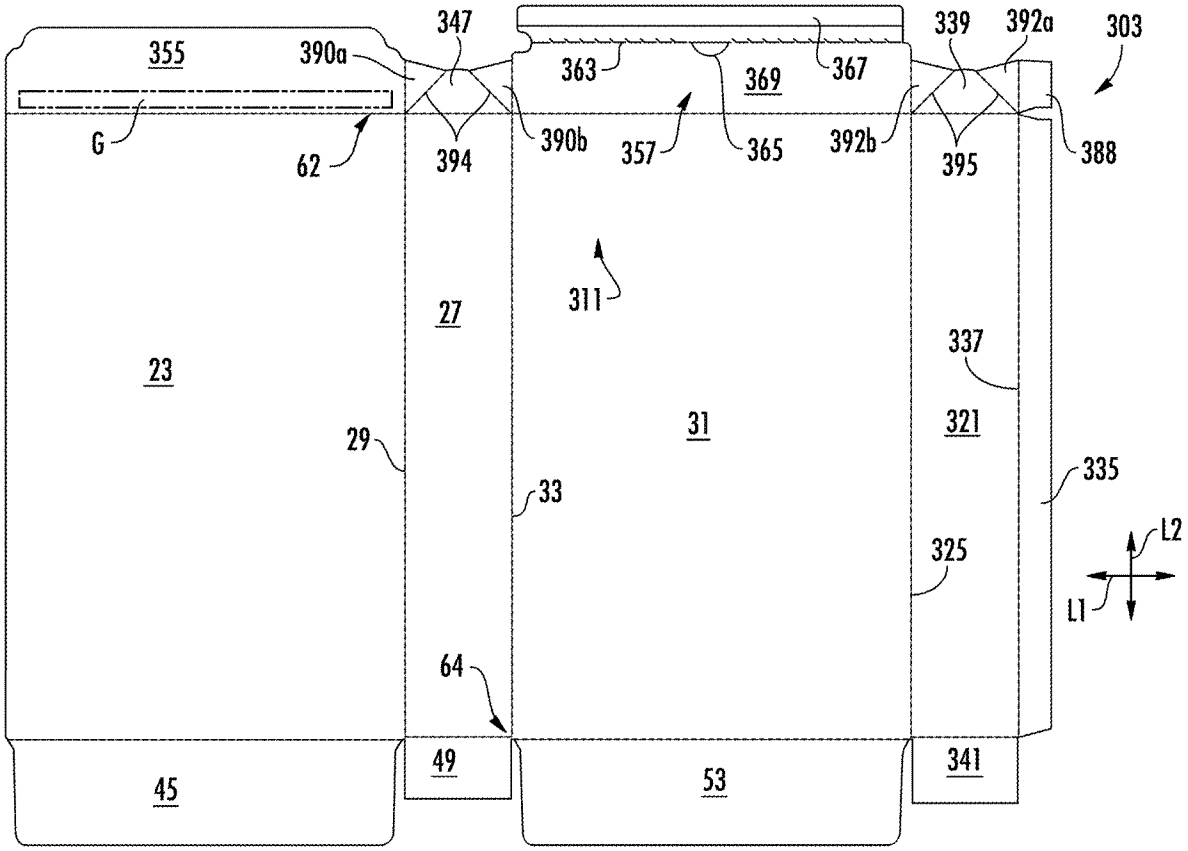
FIG. 17 is a plan view of a blank for forming a carton according to a fourth embodiment of the disclosure.
Figure 18:
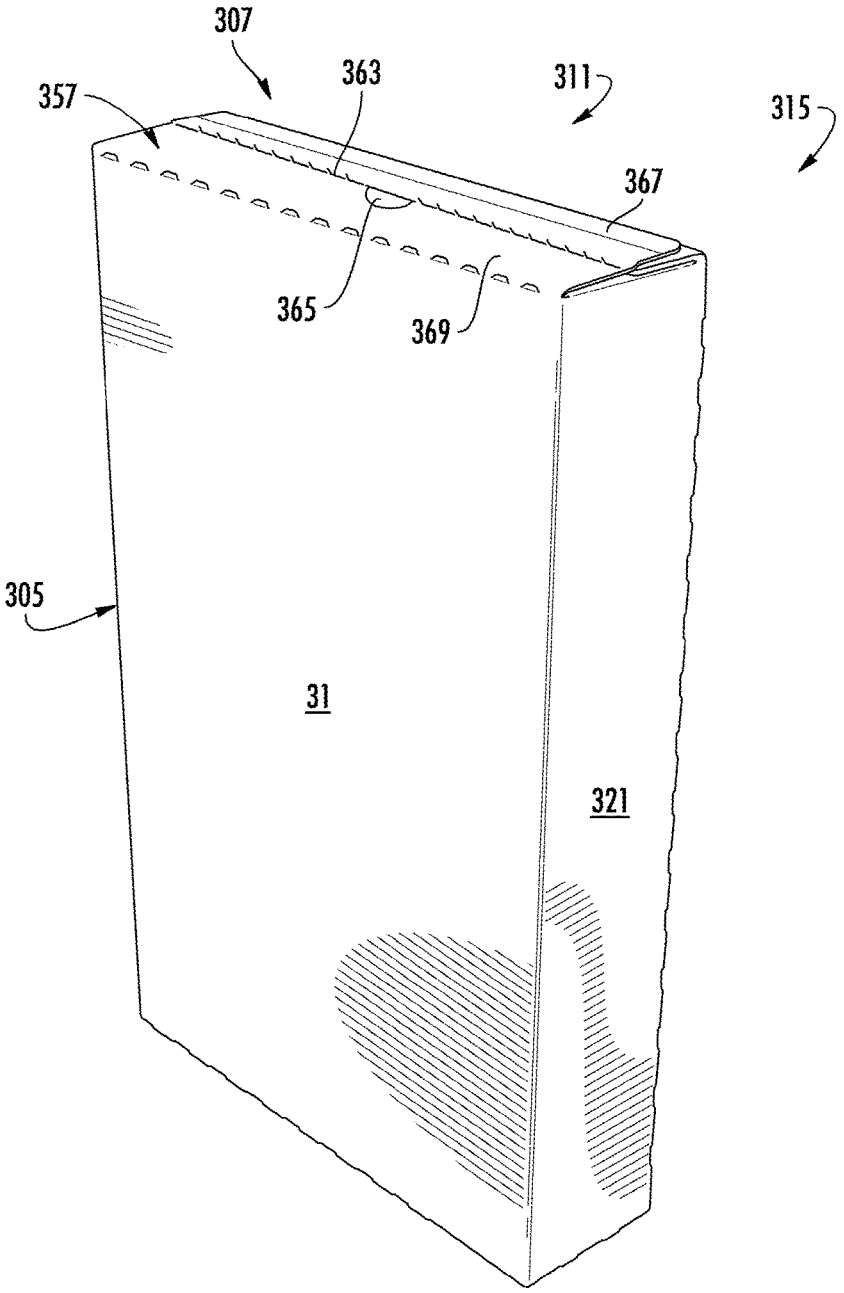
FIG. 18 is a perspective view of the erected carton according to the fourth embodiment of the disclosure.

FIG. 17 is a plan view of a blank 303 for forming a carton 305 and a package 315 (FIGS. 18-21) of a fourth embodiment of the disclosure. The fourth embodiment is generally similar to the first embodiment, except for variations noted and variations that will be apparent to one of ordinary skill in the art. Accordingly, similar or identical features of the embodiments have been given like or similar reference numbers. As shown in FIG. 17, the back panel 321 is foldably connected to the second side panel 31 along lateral fold line 325, and the attachment flap 335 is foldably connected to the back panel 321 along lateral fold line 337. In the illustrated embodiment, the blank 303 has dispenser features 311 that extend along the top portion of the blank, including a first dispenser flap 355, a second dispenser flap 369, a front top flap 347, and a back top flap 339. The front top flap 347 can be foldably connected to the first dispenser flap 355 and the second dispenser flap 357 along respective gusset panels 390*a*, 390*b*, and the back top flap 339 can be foldably connected to an attachment tab 388 and the second dispenser flap 357 along respective gussets panels 392*a*, 392*b*. In one embodiment, the gusset panels 390*a*, 390*b* are foldably connected to the front top flap 347 along respective oblique fold lines 394 and to the respective dispenser flaps 355, 357 along the respective lateral fold lines 29, 33. Similarly, the gusset panels 392*a*, 392*b* can be foldably connected to the back top flap 339 along respective oblique fold lines 395 and to the respective attachment tab 388 and second dispenser flap 357 along the respective lateral fold lines 337, 325.

Figure 19:
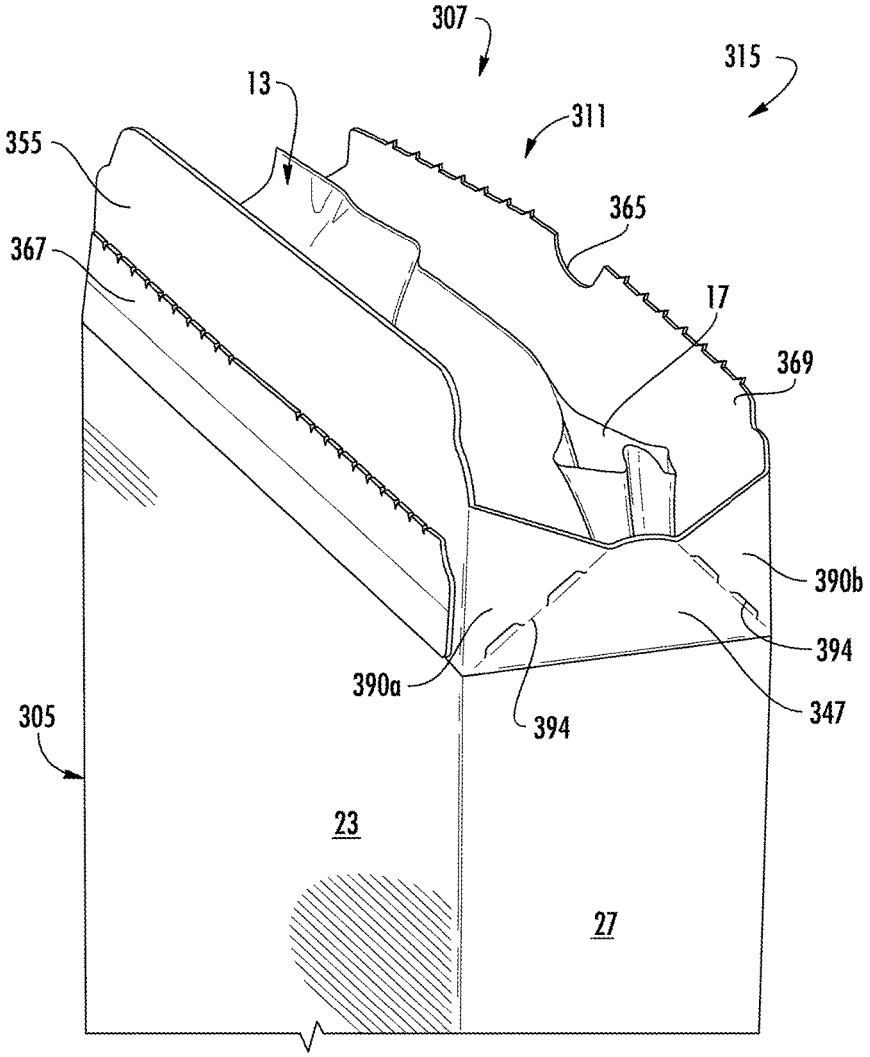
FIG. 19 is a perspective view of the carton of FIG. 18 with an open dispenser according to the fourth embodiment of the disclosure.

As shown in FIG. 17, the second dispenser flap 357 can include a distal glue portion 367 separable from a reclosable flap 369 along a tear line 363. An access aperture 365 can be formed in the reclosable flap 369 for grasping the reclosable flap 369 and pulling upwardly to tear the reclosable flap 369 from the glue portion 367 along the tear line 363 to open the dispenser 311 (FIG. 19). As shown in FIG. 17, a longitudinal fold line can extend across the distal glue portion 367. The blank 303 could be otherwise shaped, arranged, positioned, and/or configured, without departing from the disclosure.

In the fourth embodiment, when the carton 305 is formed, the attachment flap 335 is attached (e.g., glued) to the interior surface of the first side panel 23 and the attachment tab 388 is attached (e.g., glued) to the interior surface of the first dispenser flap 355. Accordingly, the gusset panel 392*b* connects the back top flap 339 to the first dispenser flap 355 via the attachment tab 388. In the illustrated embodiment, the top 307 of the carton 305 can be closed by folding the top flaps 339, 347 inwardly over the open top. In one embodiment, this can cause the gusset panels 390*a*, 390*b*, 392*a*, 392*b* to fold inwardly and overlap the respective top flaps 347, 339 and the dispenser panels 355, 357 to fold downwardly and overlap the respective gusset panels 390*a*, 392*a* and 390*b*, 392*b*. The second dispenser flap 357 can partially overlap the first dispenser flap 355, and the glue portion 367 of the second dispenser flap 357 can be glued to the first dispenser flap 355 (e.g., by a glue strip G; FIG. 17). The carton 305 could be otherwise formed and/or the top 307 could be otherwise closed without departing from the disclosure.

Figure 20B:
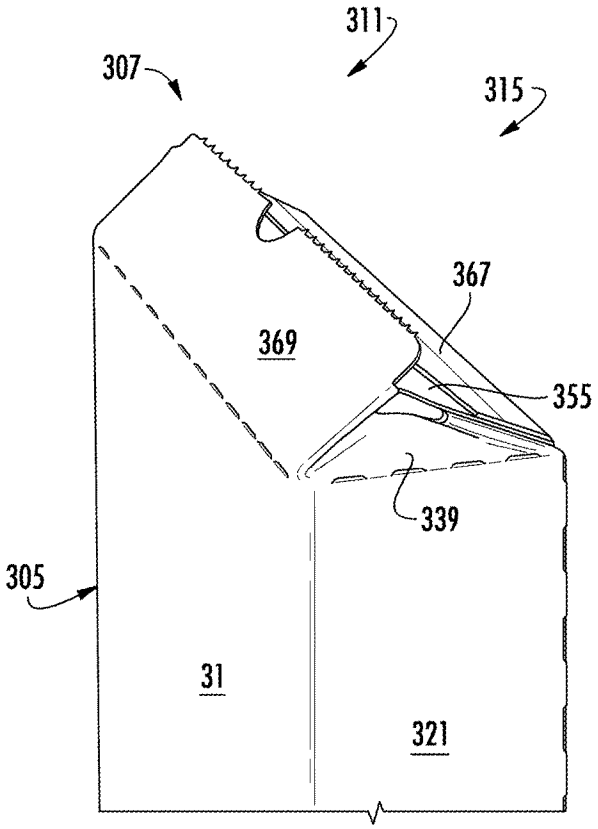
FIGS. 20A and 20B are perspective views of the carton of FIG. 19 showing the closing of the dispenser according to the fourth embodiment of the disclosure.
Figure 20A:
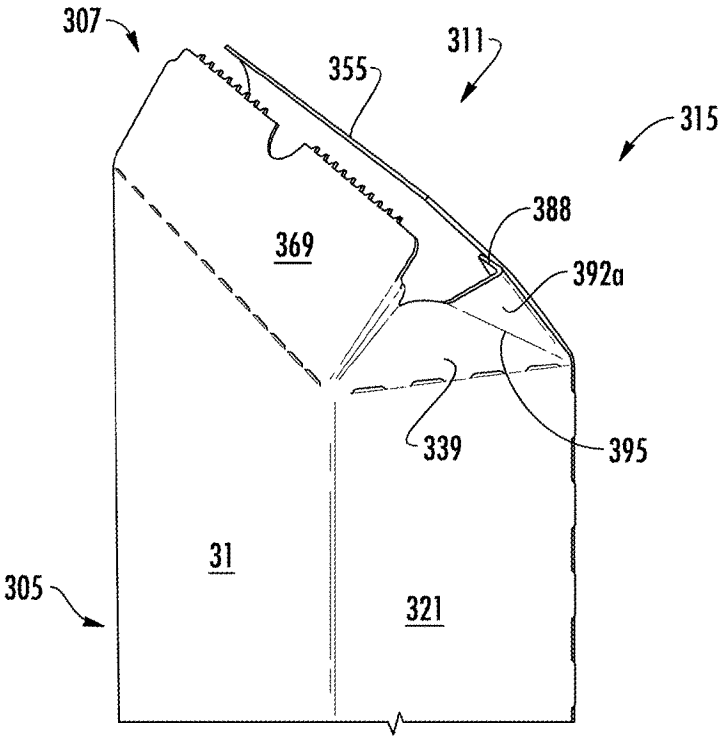
Figure 21:
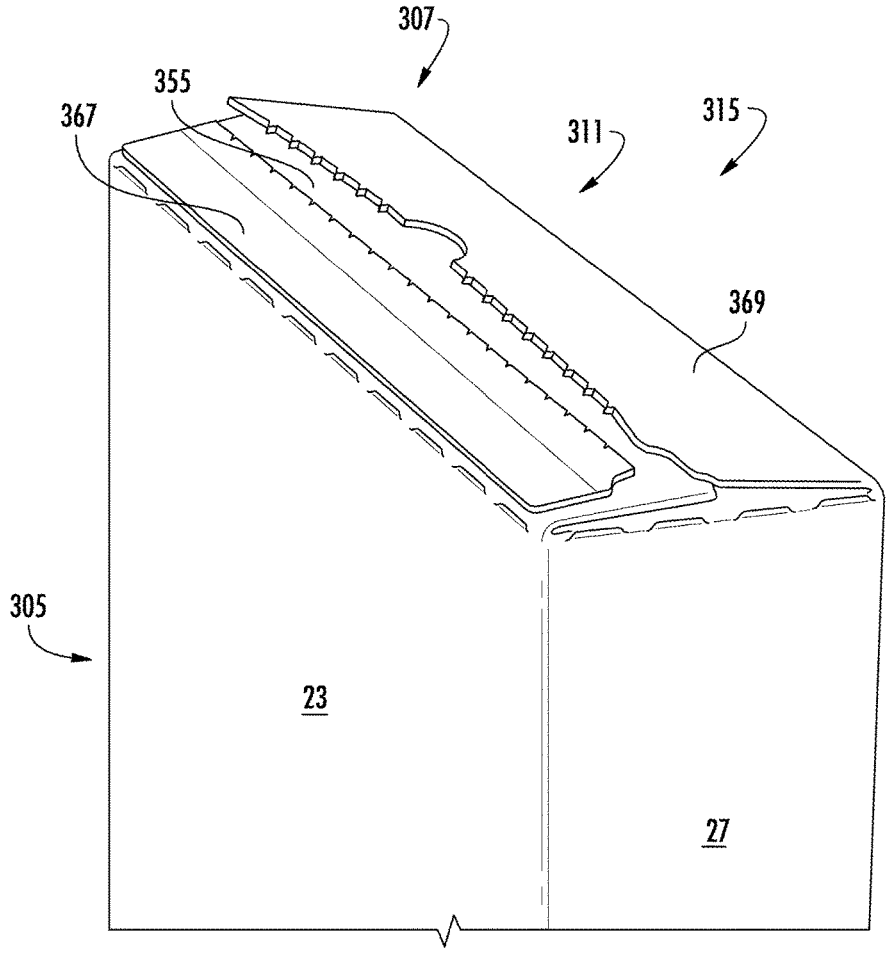
FIG. 21 is a perspective view of the carton of FIG. 18 with a reclosed dispenser according to the fourth embodiment of the disclosure.

As shown in FIG. 19, the dispenser 311 can be opened by grasping the reclosable flap 369 at the access feature 365, pulling upwardly to tear the reclosable flap 369 away from the glue portion 367 along the tear line 363, and pivoting the reclosable flap 369 upwardly top open the top 307 of the carton 305. Since the first dispenser flap 355, the reclosable flap 369, and the top flaps 347, 339 are interconnected by the gusset panels 390*a*, 390*b*, 392*a*, 392*b*, the pivoting of the reclosable flap 369 can cause the first dispenser flap 355 and the top flaps 347, 339 to pivot upwardly as well. As shown in FIGS. 20A and 20B, the top 307 can be closed by folding the first dispenser flap 355, the reclosable flap 369, and the top flaps 339, 347 downwardly over the top and tucking the first dispenser flap 355 partially under the reclosable flap 369. In one embodiment, the top of the bag 13 can be at least partially trapped between the reclosable flap 369 and the first dispenser flap 355 to help close (e.g., at least partially seal) the top of the bag 13, which can help keep the contents of the bag fresh. The reclosed carton 305 is shown in FIG. 21 in one example. In one exemplary embodiment, a top portion of the bag 13 can be glued to the reclosable flap 369 so that the top of the bag is folded and sandwiched between the reclosable flap 369 and the first dispenser flap 355 when the dispenser 311 is closed. The dispenser 311 could be otherwise opened and/or closed without departing from the disclosure.

Figure 22:
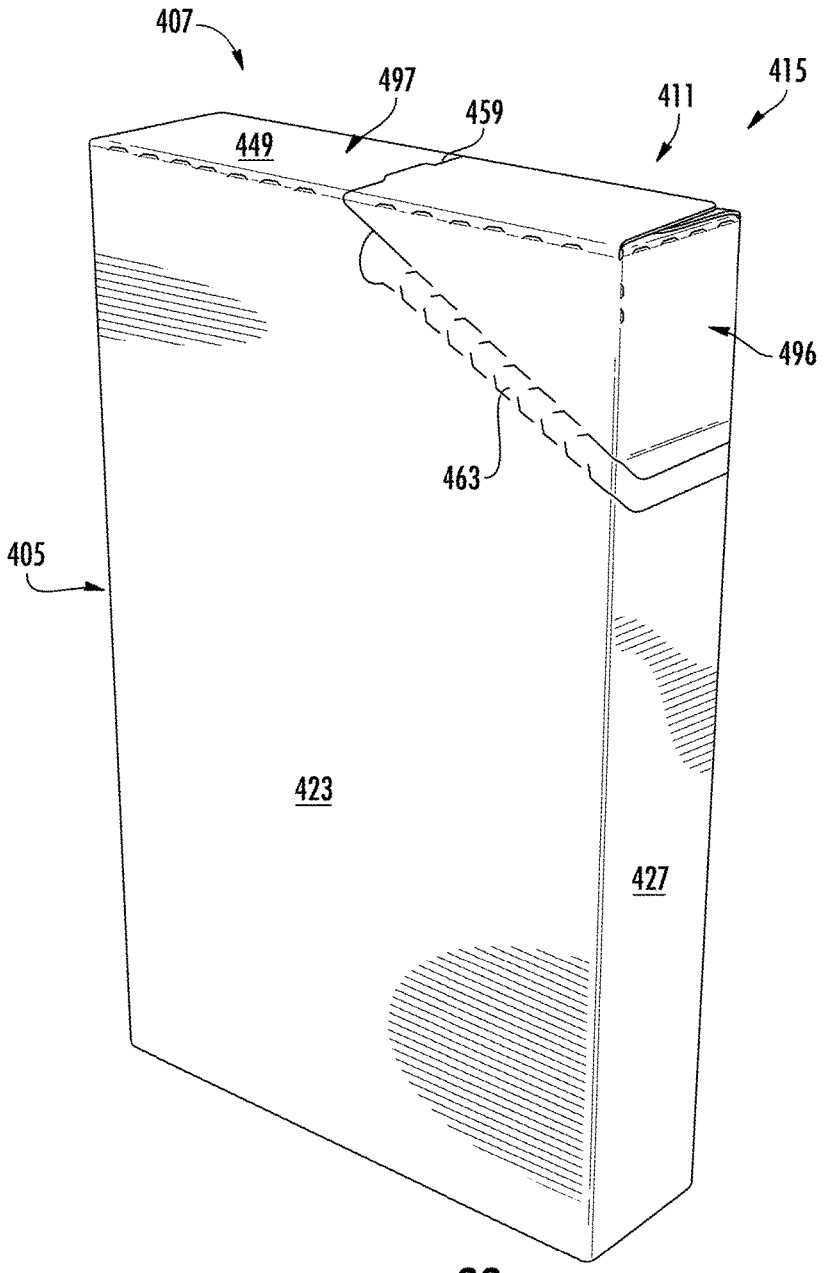
FIG. 22 is a perspective view of an erected carton according to a fifth embodiment of the disclosure.
Figure 23:
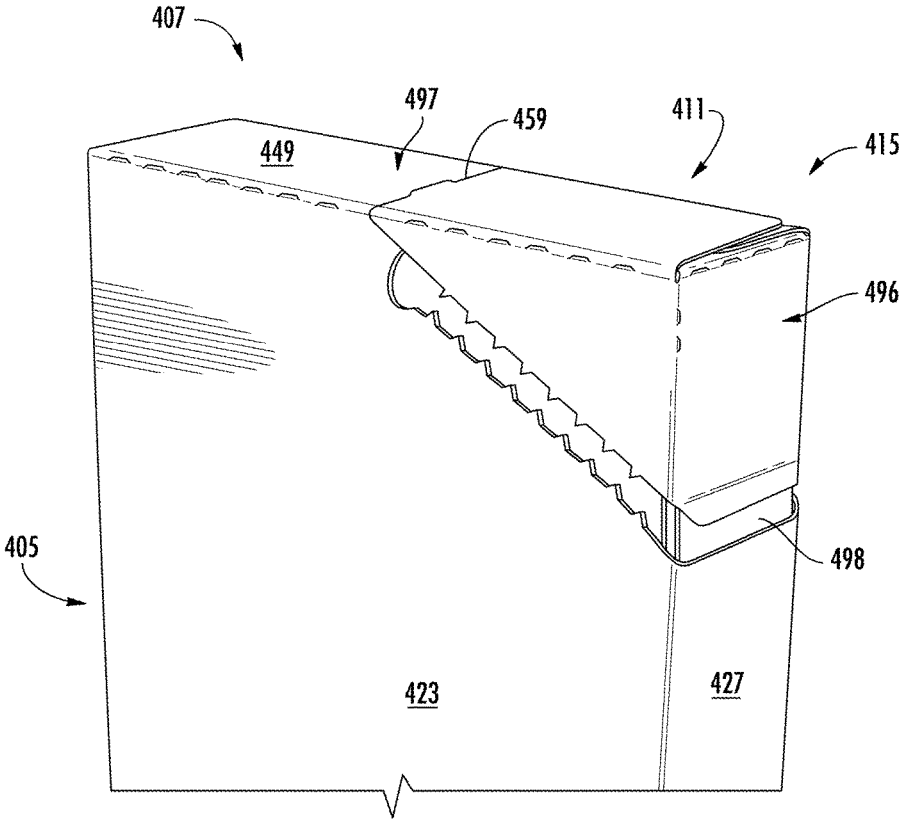
FIG. 23 is a perspective view of the carton of FIG. 22 with a partially open dispenser according to the fifth embodiment of the disclosure.
Figure 24A:
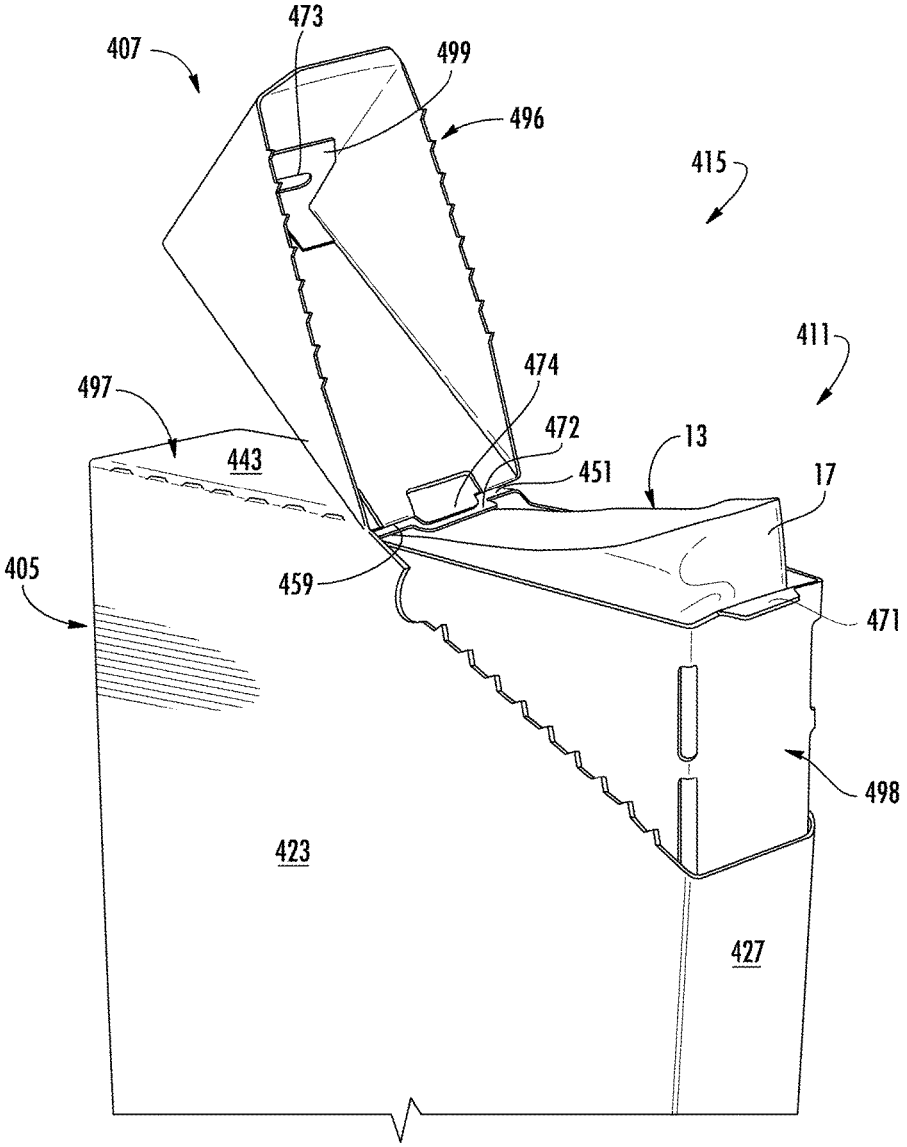
FIGS. 24A and 24B are perspective views of the carton of FIG. 22 with an open dispenser according to the fifth embodiment of the disclosure.
Figure 24B:
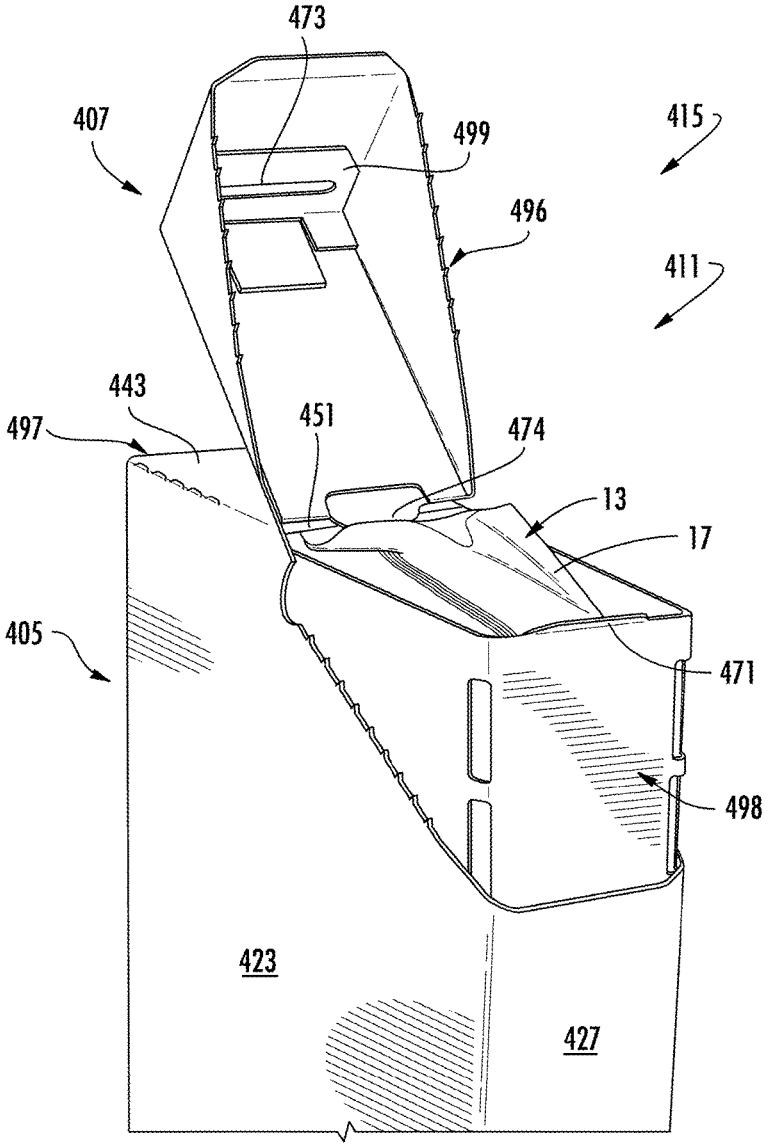

FIG. 22 is a perspective view of a package 415 including a carton 405 formed from at least one blank (not shown) in a fifth embodiment of the disclosure. The fifth embodiment is generally similar to the first embodiment, except for variations noted and variations that will be apparent to one of ordinary skill in the art. Accordingly, similar or identical features of the embodiments have been given like or similar reference numbers. As shown in FIG. 22, the dispenser 411 includes a flip top 496 that is separable from the side panels 423, 431 and the front panel 427 by a tear strip 463. The flip top 496 is foldably connected to a top wall 497 of the carton 405 formed by the first side top flap 443, the second side top flap 451 (FIGS. 24A and 24B), and/or other top flaps (not shown) along a fold line 459. As shown in FIGS. 23-24A, the dispenser 411 can be opened by tearing the tear strip 463 away from the carton and pivoting the flip top 496 upwardly along the fold line 459.

As shown in FIGS. 24A and 24B, the dispenser 411 can include features for helping the flip top 496 to stay open during dispensing of the flowable material F and/or to stay closed for storage. For example, a front wall insert 498 can be glued to the interior surface of the front panel 427 and the side panels 423, 431. The front wall insert 498 can include a foldably-connected front locking tab 471, and a locking insert 499 can be glued or otherwise secured to an interior of the flip top 496. The locking insert 499 can have an aperture 473 for receiving the front locking tab 471 so that the interaction between the front locking tab 473 and the locking insert 499 can help retain the flip top 496 in the closed position. In the illustrated embodiment, a first interference tab 472 can extend from the second side top flap 451 and a second interference tab 474 can extend from a rear portion of the flip top 496. As shown in FIGS. 24A and 24B, the interference tabs 472, 474 can interfere with the movement of one another so that the interference tab 474 forces the interference tab 472 and the second side top flap 451 to flex and/or pivot downwardly as the flip top 496 pivots open or closed. Accordingly, the interference tabs 472, 474 can help retain the flip top 496 in the open or closed position. In one embodiment, the interaction of the locking features can cause an audible noise (e.g., a "click," "snap," or other sound) to indicate to the user that the dispenser 411 is closed. The package 415 could be otherwise shaped, arranged, positioned, and/or configured, without departing from the disclosure.

Any of the features of the various embodiments of the disclosure can be combined with, replaced by, or otherwise configured with other features of other embodiments of the disclosure without departing from the scope of this disclosure. Further, the panels, flaps, dispensers, bags, and/or other features shown and described in conjunction with the blanks 3, 103, 203, 303, the cartons 5, 105, 205, 305, 405, and/or the packages 15, 115, 215, 315, 415 of the above embodiments are included by way of example. The dispensers, bags, and/or other features of the disclosure can alternatively be associated with any suitable carton having any panel and flap configuration.

The cartons according to the present disclosure can be, for example, formed from blanks of coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels, flaps, or features, adhered together by glue during erection of the carton embodiments. The term "glue"

is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package for holding a product, the package comprising a carton and a bag, the carton comprising:

a plurality of panels extending at least partially around an interior of the carton, the plurality of panels comprises a front panel, a first side panel foldably connected to the front panel, a second side panel foldably connected to the front panel, and a back panel foldably connected to at least one of the first side panel and the second side panel;

a plurality of top end flaps foldably connected to respective panels of the plurality of panels, the plurality of top end flaps are for at least partially closing a top end of the carton, the plurality of top end flaps comprising a front top flap foldably connected to the front panel;

a plurality of bottom end flaps foldably connected to respective panels of the plurality of panels, the plurality of bottom end flaps are for at least partially closing a bottom end of the carton; and a dispenser for accessing the interior of the carton through the top end of the carton, the dispenser comprising at least one dispenser flap at least partially closing a top of the carton, the at least one dispenser flap comprising a first dispenser flap and a second dispenser flap, the dispenser further comprising a liner patch overlapping at least a portion of the first dispenser flap, the second dispenser flap, and the front top flap at the top end of the carton such that the liner patch extends from the interior of the carton through the dispenser when the dispenser is open, the liner patch is free from contact with the plurality of bottom end flaps;

wherein the bag contains the product and is at least partially disposed in the interior of the carton and is in contact with the plurality of bottom end flaps at the bottom end of the carton, the bag is disposed below the liner patch, and the bag comprises a dispenser feature that is accessible via the dispenser in the carton.

2. The package of claim 1, wherein the bag comprises a top seal, and at least a portion of the top seal comprises an oblique seal that extends obliquely with respect to a top end of the bag.

3. The package of claim 2, wherein the dispenser feature of the bag is at least partially defined by the oblique seal and the top end of the bag.

4. The package of claim 2, wherein an edge of the oblique seal is aligned with an edge of the dispenser.

5. The package of claim 1, wherein the bag comprises a top seal extending across the bag, the top seal extending obliquely with respect to a top end of the bag.

6. The package of claim 1, wherein the first dispenser flap at least partially overlaps the second dispenser flap, the first dispenser flap comprising a distal portion secured to the second dispenser flap.

7. The package of claim 6, wherein a tear feature extends across at least a portion of the first dispenser flap and at least partially defines the distal portion and a reclosable flap in the first dispenser flap.

8. The package of claim 7, wherein the reclosable flap comprises a closing tab at least partially defined by the tear feature, and the second dispenser flap comprises a notch for at least partially receiving the closing tab after the tear feature has been actuated to at least partially separate the reclosable flap from the distal portion of the first dispenser flap.

9. The package of claim 6, wherein the front panel extends between the first side panel and the second side panel, the first dispenser flap is foldably connected to the first side panel along a first portion of a fold line, and the second dispenser flap is foldably connected to the second side panel along a second portion of the fold line.

10. The package of claim 9, wherein each of the first portion and the second portion of the fold line is oblique with respect to the front panel.

11. The package of claim 9, wherein the plurality of top end flaps further comprises a first top flap foldably connected to the first side panel along the fold line and a second top flap foldably connected to the second side panel along the fold line, the first top flap and the second top flap being at least partially overlapped with one another to at least partially close the top of the carton.

12. The package of claim 11, wherein the first dispenser flap is connected to the first top flap along a first tear line, the second dispenser flap is connected to the second top flap along a second tear line, and each of the first dispenser flap and the second dispenser flap is at least partially separable from the respective first top flap and second top flap along the respective first tear line and second tear line.

13. The package of claim 9, wherein the second dispenser flap at least partially overlaps the front top flap.

14. The package of claim 6, wherein the first dispenser flap is foldably connected to the first side panel, the second dispenser flap is foldably connected to the second side panel, the front top flap is foldably connected to the front panel and the carton further comprises a back top flap foldably connected to the back panel.

15. The package of claim 14, wherein the front top flap is connected to the first dispenser flap and the second dispenser flap by a respective first front gusset panel and second front gusset panel, and the back top flap is connected to the first dispenser flap and the second dispenser flap by a respective first back gusset panel and second back gusset panel.

16. The package of claim 15, wherein the first dispenser flap comprises a reclosable flap that is separable from the distal portion of the first dispenser flap along a tear feature, a top portion of the bag is attached to the reclosable flap so that at least a portion of the top portion of the bag is disposed between the reclosable flap and the second dispenser flap when the dispenser is in a closed configuration.

17. The package of claim 1, wherein the carton further comprises a spout feature extending in at least the front panel and the front top flap.

18. The package of claim 17, wherein the spout feature comprises a lateral fold line extending in the front top flap and two oblique fold lines extending in the front panel from an end of the lateral fold line, the front top flap and the front panel being for folding along the lateral fold line and the oblique fold lines to form a spout adjacent the dispenser when the dispenser is in an open configuration.

19. The package of claim 1, wherein the carton further comprises a top wall at least partially closing a top of the carton, and the dispenser comprises a flip top foldably connected to the top wall, the flip top being positionable between a closed position and an open position.

20. The package of claim 19, wherein the carton comprises a front wall insert attached to at least one panel of the plurality of panels, the flip top at least partially overlaps the front wall insert in the closed position, the front wall insert comprises a locking tab, and the dispenser comprises a locking insert attached to an interior surface of the flip top for engaging the locking tab when the flip top is in the closed position.

21. In combination, a blank for forming a carton and a bag for being disposed in an interior of the carton, the blank comprising:

a plurality of panels, the plurality of panels comprises a front panel, a first side panel foldably connected to the front panel, a second side panel foldably connected to the front panel, and a back panel foldably connected to at least one of the first side panel and the second side panel;

a plurality of top end flaps foldably connected to respective panels of the plurality of panels, the plurality of top end flaps are for at least partially closing a top end of the carton formed from the blank, the plurality of top end flaps comprising a front top flap foldably connected to the front panel;

a plurality of bottom end flaps foldably connected to respective panels of the plurality of panels, the plurality of bottom end flaps are for at least partially closing a bottom end of the carton formed from the blank; and dispenser features for forming a dispenser for accessing the interior of the carton through the top end of the carton formed from the blank, the dispenser features comprising at least one dispenser flap for at least partially closing a top of the carton formed from the blank, the at least one dispenser flap comprising a first dispenser flap and a second dispenser flap, the dispenser features further comprising a liner patch overlapping at least a portion of the first dispenser flap, the second dispenser flap, and the front top flap such that the liner patch extends from the interior of the carton through the dispenser when the carton is formed from the blank and the dispenser is open, the liner patch is free from contact with the plurality of bottom end flaps;

wherein the bag contains the product and comprises a dispenser feature that is for being accessible via the dispenser when the carton is formed from the blank, the bag is at least partially disposed in the interior of the carton formed from the blank, is in contact with the plurality of bottom end flaps at the bottom end of the carton formed from the blank, and is for being disposed below the liner patch when the carton is formed from the blank.

22. The combination of claim 21, wherein the bag comprises a top seal, and at least a portion of the top seal comprises an oblique seal that extends obliquely with respect to a top end of the bag.

23. The combination of claim 22, wherein the dispenser feature of the bag is at least partially defined by the oblique seal and the top end of the bag.

24. The combination of claim 22, wherein an edge of the oblique seal is for alignment with an edge of the dispenser when the carton is formed from the blank.

25. The combination of claim 21, wherein the bag comprises a top seal extending across the bag, the top seal extending obliquely with respect to a top end of the bag.

26. The combination of claim 21, wherein the first dispenser flap comprises a distal portion for being secured to the second dispenser flap when the carton is formed from the blank.

27. The combination of claim 26, wherein a tear feature extends across at least a portion of the first dispenser flap and at least partially defines the distal portion and a reclosable flap in the first dispenser flap.

28. The combination of claim 27, wherein the reclosable flap comprises a closing tab at least partially defined by the tear strip, and the second dispenser flap comprises a notch for at least partially receiving the closing tab after the tear feature has been actuated to at least partially separate the reclosable flap from the distal portion of the first dispenser flap when the carton is formed from the blank.

29. The combination of claim 26, wherein the front panel is foldably connected to at least one of the first side panel and the second side panel along a first fold line, the first dispenser flap is foldably connected to the first side panel along a first portion of a second fold line, and the second dispenser flap is foldably connected to the second side panel along a second portion of the second fold line.

30. The combination of claim 29, wherein each of the first portion and the second portion of the second fold line is oblique with respect to the first fold line.

31. The combination of claim 29, wherein the plurality of top end flaps further comprises a first top flap foldably connected to the first side panel along a first longitudinal portion of the second fold line and a second top flap foldably connected to the second side panel along a second longitudinal portion of the second fold line, wherein the first top flap and the second top flap are for being at least partially overlapped with one another to at least partially close the top of the carton formed from the blank.

32. The combination of claim 31, wherein the first dispenser flap is connected to the first top flap along a first tear line, the second dispenser flap is connected to the second top flap along a second tear line, and each of the first dispenser flap and the second dispenser flap is at least partially separable from the respective first top flap and second top flap along the respective first tear line and second tear line.

33. The combination of claim 26, wherein the first dispenser flap is foldably connected to the first side panel, the second dispenser flap is foldably connected to the second side panel, and the blank further comprises a back top flap foldably connected to the back panel.

34. The combination of claim 33, wherein the front top flap is connected to the first dispenser flap and the second dispenser flap by a respective first front gusset panel and second front gusset panel, and the back top flap is connected to the first dispenser flap by a first back gusset panel and to an attachment tab by a second back gusset panel, and the attachment tab is for being secured to the second dispenser flap when the carton is formed from the blank.

35. The combination of claim 21, further comprising a spout feature extending in at least the front panel and the front top flap.

36. The combination of claim 35, wherein the spout feature comprises a lateral fold line extending in the front top flap and two oblique fold lines extending in the front panel from an end of the lateral fold line, the front top flap and the front panel being for folding along the lateral fold line and the oblique fold lines to form a spout adjacent the dispenser when the carton is formed from the blank.

37. A method of forming a package comprising:

obtaining a blank comprising a plurality of panels and dispenser features comprising at least one dispenser flap, the plurality of panels comprises a front panel, a first side panel foldably connected to the front panel, a second side panel foldably connected to the front panel, and a back panel foldably connected to at least one of the first side panel and the second side panel, the at least one dispenser flap comprising a first dispenser flap and a second dispenser flap, the blank further comprises a plurality of top end flaps foldably connected to respective panels of the plurality of panels, the plurality of end flaps comprising a front top flap foldably connected to the front panel, and a plurality of bottom end flaps foldably connected to respective panels of the plurality of panels;

attaching a liner patch to the blank overlapping at least a portion of the first dispenser flap, the second dispenser flap, and the front top flap, the liner patch is free from contact with the plurality of bottom end flaps;

forming an interior of the carton at least partially defined by the plurality of panels;

positioning a bag containing a product at least partially in the interior of the, the bag comprising a dispenser feature;

closing the top end of the carton by at least partially overlapping the plurality of top end flaps, the bag is disposed below the liner patch;

closing the bottom end of the carton by at least partially overlapping the plurality of bottom end flaps, the bag is in contact with the plurality of bottom end flaps at the bottom end of the carton; and forming a dispenser at least partially defined by the dispenser features, the forming the dispenser comprising positioning the at least one dispenser flap to at least partially close the top of the carton, the dispenser feature of the bag being accessible via the dispenser, the liner patch extends from the interior of the carton through the dispenser when the dispenser is open.

38. The method of claim 37, further comprising forming a top seal along a top end of the bag so that at least a portion of the top seal comprises an oblique seal that extends obliquely with respect to the top end of the bag.

39. The method of claim 38, wherein the dispenser feature of the bag is at least partially defined by the oblique seal and the top end of the bag.

40. The method of claim 38, wherein an edge of the oblique seal is aligned with an edge of the dispenser when the dispenser is formed.

41. The method of claim 37, wherein the first dispenser flap comprises a distal portion at least partially defined by a tear feature, and the positioning the at least one dispenser flap further comprises positioning the first dispenser flap to at least partially overlap the second dispenser flap to at least partially close the top of the carton and securing the distal portion to the second dispenser flap.

42. The method of claim 41, wherein the plurality of top end flaps further comprises a second top flap, the plurality of panels comprises a first side panel and a second side panel, the first top flap and the first dispenser flap are foldably connected to the first side panel, the second top flap and the second dispenser flap are foldably connected to the second side panel, and the closing the top end comprises at least partially overlapping the first top flap and the second top flap to at least close the top of the carton.

43. A package for holding a product, the package comprising a carton and a bag, the carton comprising:

a plurality of panels comprising a first side panel, a second side panel, and a front panel extending at least partially around an interior of the carton, the front panel defines a first plane; and a dispenser for accessing the interior of the carton, the dispenser comprising at least a first dispenser flap and a second dispenser flap at least partially closing a top of the carton, each of the first dispenser flap and the second dispenser flap foldably connected to the respective first side panel and second side panel at a respective fold line that is oblique relative to the front panel, at least one of the first dispenser flap and the second dispenser flap defines a free distal edge, at least a portion of the free distal edge is parallel to the respective fold line, the dispenser defines a second plane that is oblique relative to the first plane;

wherein the bag is at least partially disposed in the interior of the carton, and the bag comprises a dispenser feature that is accessible via the dispenser in the carton.

44. The package of claim 43, wherein the dispenser extends in an oblique direction between the top of the carton and the front panel.

45. The package of claim 43, wherein the first dispenser flap comprises a distal portion secured to the second dispenser flap, and a tear feature extends across at least a portion of the first dispenser flap and at least partially defines the distal portion and a reclosable flap in the first dispenser flap.

46. The package of claim 43, wherein an entirety of at least one of the first dispenser flap and the second dispenser flap is oblique relative to the front panel.

47. The package of claim 43, wherein one of the first side panel and the second side panel defines a third plane, the second plane is substantially perpendicular to the third plane.

48. In combination, a blank for forming a carton and a bag for being disposed in an interior of the carton, the blank comprising:

a plurality of panels comprising a first side panel, a second side panel, and a front panel; and dispenser features for forming a dispenser for accessing the interior of the carton formed from the blank, the dispenser features comprising at least a first dispenser flap and a second dispenser flap for at least partially closing a top of the carton formed from the blank, each of the first dispenser flap and the second dispenser flap foldably connected to the respective first side panel and the second side panel at a respective fold line that is oblique relative to the front panel, at least one of the first dispenser flap and the second dispenser flap defines a free distal edge, at least a portion of the free distal edge is parallel to the respective fold line;

wherein the bag comprises a dispenser feature that is for being accessible via the dispenser when the carton is formed from the blank.

49. The combination of claim 48, wherein the dispenser features are for forming the dispenser extending in an oblique direction between the top of the carton and the front panel when the carton is formed from the blank.

50. The combination of claim 48, wherein the first dispenser flap comprises a distal portion for being secured to the second dispenser flap when the carton is formed from the blank, and a tear feature extends across at least a portion of the first dispenser flap and at least partially defines the distal portion and a reclosable flap in the first dispenser flap.

51. The combination of claim 48, wherein the respective fold line comprises a first oblique fold line foldably connecting the first dispenser flap to the first side panel and a second oblique fold line foldably connecting the second dispenser flap to the second side panel, the free distal edge comprises a first free distal edge of the first dispenser flap and a second free distal edge of the second dispenser flap, the first free distal edge is parallel to the first oblique fold line and the second free distal edge is parallel to the second oblique fold line.

52. The combination of claim 48, wherein an entirety of at least one of the first dispenser flap and the second dispenser flap is oblique relative to the front panel in the carton formed from the blank.

53. The combination of claim 48, wherein the front panel defines a first plane of the carton formed from the blank, the dispenser defines a second plane of the carton formed from the blank, the second plane is oblique relative to the first plane, one of the first side panel and the second side panel defines a third plane in the carton formed from the blank, the second plane is substantially perpendicular to the third plane when the carton is formed from the blank.

54. A method of forming a package comprising:

obtaining a blank comprising a plurality of panels and dispenser features comprising at least one dispenser flap, the plurality of panels comprising a first side panel, a second side panel, and a front panel, the at least one dispenser flap comprising a first dispenser flap and a second dispenser flap, each of the first dispenser flap and the second dispenser flap foldably connected to the respective first side panel and the second side panel at a respective fold line that is oblique relative to the front panel, at least one of the first dispenser flap and the second dispenser flap defines a free distal edge, at least a portion of the free distal edge is parallel to the respective fold line;

forming an interior of the carton at least partially defined by the plurality of panels such that the front panel defines a first plane;

positioning a bag at least partially in the interior of the carton, the bag comprising a dispenser feature; and forming a dispenser at least partially defined by the dispenser features, the forming the dispenser comprising positioning the at least one dispenser flap to at least partially close a top of the carton, the dispenser feature of the bag being accessible via the dispenser, the dispenser defines a second plane that is oblique relative to the first plane.

55. The method of claim 54, wherein the forming the dispenser comprises forming the dispenser extending in an oblique direction between the top of the carton and the front panel.

56. The method of claim 54, wherein the first dispenser flap comprises a distal portion and a tear feature extends across at least a portion of the first dispenser flap and at least partially defines the distal portion and a reclosable flap in the first dispenser flap, and wherein the forming the dispenser comprises securing the distal portion of the first dispenser flap to the second dispenser flap.

57. The method of claim 54, wherein an entirety of at least one of the first dispenser flap and the second dispenser flap is oblique relative to the front panel.

58. The method of claim 54, wherein one of the first side panel and the second side panel defines a third plane, the second plane is substantially perpendicular to the third plane.

59. A package for holding a product, the package comprising a carton and a bag, the carton comprising:

a plurality of panels extending at least partially around an interior of the carton, the plurality of panels comprises a front panel, a first side panel foldably connected to the front panel, a second side panel foldably connected to the front panel, and a back panel foldably connected to at least one of the first side panel and the second side panel;

a plurality of top end flaps foldably connected to respective panels of the plurality of panels, the plurality of top end flaps are for at least partially closing a top end of the carton, the plurality of top end flaps comprising a front top flap foldably connected to the front panel;

a plurality of bottom end flaps foldably connected to respective panels of the plurality of panels, the plurality of bottom end flaps are for at least partially closing a bottom end of the carton; and a dispenser for accessing the interior of the carton through the top end of the carton, the dispenser comprising at least one dispenser flap at least partially closing a top of the carton, the at least one dispenser flap comprising a first dispenser flap and a second dispenser flap, the dispenser further comprising a liner patch overlapping at least a portion of the first dispenser flap, the second dispenser flap, and the front top flap at the top end of the carton such that the liner patch extends from the interior of the carton through the dispenser when the dispenser is open, wherein the liner patch has a lowermost edge spaced apart from the bottom end of the carton;

wherein the bag contains the product and is at least partially disposed in the interior of the carton and is in contact with the plurality of bottom end flaps at the bottom end of the carton, the bag is disposed below the liner patch, and the bag comprises a dispenser feature that is accessible via the dispenser in the carton.

* * * * *